US009754460B2

(12) United States Patent
Sato et al.

(10) Patent No.: US 9,754,460 B2
(45) Date of Patent: Sep. 5, 2017

(54) GAME MACHINE

(71) Applicant: BANDAI NAMCO Games Inc., Shinagawa-ku, Tokyo (JP)

(72) Inventors: Yoshinori Sato, Zama (JP); Tetsuo Tokitou, Sagamihara (JP); Akihiko Tokue, Samukawa-machi (JP)

(73) Assignee: BANDAI NAMCO Entertainment Inc., Tokyo (JP)

( * ) Notice: Subject to any disclaimer, the term of this patent is extended or adjusted under 35 U.S.C. 154(b) by 354 days.

(21) Appl. No.: 14/325,709

(22) Filed: Jul. 8, 2014

(65) Prior Publication Data

US 2015/0018058 A1 Jan. 15, 2015

(30) Foreign Application Priority Data

Jul. 10, 2013 (JP) ..... 2013-145052

(51) Int. Cl.
*G07F 17/38* (2006.01)
*A63F 7/00* (2006.01)
(Continued)

(52) U.S. Cl.
CPC ..... *G07F 17/38* (2013.01); *A63F 3/0645* (2013.01); *A63F 7/0058* (2013.01);
(Continued)

(58) Field of Classification Search
USPC ..... 463/5, 6, 7, 8
See application file for complete search history.

(56) References Cited

U.S. PATENT DOCUMENTS 4,120,497 A 10/1978 Goldfarb et al.
4,900,026 A 2/1990 Kulesza et al.
(Continued)

FOREIGN PATENT DOCUMENTS

EP 1 547 657 A1 6/2005
GB 641504 A 8/1950
(Continued)

OTHER PUBLICATIONS

Search Report dated Dec. 3, 2014 issued in corresponding GB patent application No. GB1412033.1.

*Primary Examiner* — Dmitry Suhol
*Assistant Examiner* — Brandon Gray
(74) *Attorney, Agent, or Firm* — Posz Law Group, PLC

(57) ABSTRACT

A game machine includes: game medium release means that releases a plurality of game media to a determination area included in a game space based on an operation input from operation section; detection means that detects the occurrence or non-occurrence of a predetermined event at a plurality of determination points provided in the determination area, the predetermined event occurring due to a released game medium among the plurality of game media; and determination means that performs a win determination process based on the occurrence or non-occurrence of the predetermined event at the plurality of determination points provided in the determination area, the determination means determining that the player has won the game when a plurality of determination points among the plurality of determination points at which the predetermined event has occurred satisfy a winning condition.

19 Claims, 18 Drawing Sheets

(51) Int. Cl.

| | |
|---|---|
| ***A63F 3/06*** | (2006.01) |
| ***A63F 7/24*** | (2006.01) |
| ***G07F 17/32*** | (2006.01) |
| *A63F 9/02* | (2006.01) |
| *A63F 9/30* | (2006.01) |

(52) U.S. Cl.
CPC ..... *A63F 7/2472* (2013.01); *G07F 17/3216* (2013.01); *A63F 9/0247* (2013.01); *A63F 9/30* (2013.01)

(56) References Cited

U.S. PATENT DOCUMENTS

| | | | | |
|---|---|---|---|---|
| 5,370,399 | A * | 12/1994 | Liverance | G07F 17/3244 434/323 |
| 5,803,451 | A | 9/1998 | Kelly et al. | |
| 8,128,476 | B1 * | 3/2012 | Sidhu | A63F 3/00643 463/10 |
| 2002/0037771 | A1 | 3/2002 | Tamura et al. | |
| 2006/0097446 | A1 | 5/2006 | Toyoda | |
| 2007/0057451 | A1 * | 3/2007 | Halliburton | A63F 5/02 273/138.1 |
| 2008/0001360 | A1 * | 1/2008 | Fukazawa | A63F 9/30 273/448 |

FOREIGN PATENT DOCUMENTS

| | | | |
|---|---|---|---|
| GB | 913064 | A | 12/1962 |
| JP | 2004-105383 | A | 4/2004 |
| JP | 2010-259596 | A | 11/2010 |
| WO | 97/38766 | A1 | 10/1997 |

* cited by examiner

| WINNING CONDITION ID | WINNING CONDITION | BONUS |
|---|---|---|
| FIRST WINNING CONDITION ID | HP11, HP21, HP31 | 30P |
| SECOND WINNING CONDITION ID | HP32, HP42, HP52, HP62 | 40P |
| THIRD WINNING CONDITION ID | HP33, HP34 | 20P |
| FOURTH WINNING CONDITION ID | HP54, HP64 | 20P |

FIG.13

502

502a

502b

| AREA ID | MOVABLE RANGE COORDINATES |
| --- | --- |
| GAME BALL STORAGE SECTION ID | P1(X1, Y1)、P2(X2、Y2) |
| BOARD SURFACE ID | P3(X1, Y3)、P4(X2、Y4) |

GAME MACHINE

Japanese Patent Application No, 2013-145052, filed on Jul. 10, 2013, is hereby incorporated by reference in its entirety.

BACKGROUND OF THE INVENTION

The present invention relates to a game machine,

A game machine that utilizes a game medium (e.g., token or game ball) in which a bingo element is incorporated has been known. For example, a bingo pinball game is designed so that the player discharges a play balls in total such that the play balls enter numbered holes within the playfield. The player wins the game when m or more consecutive numbers among n×n bingo cards have lit up along one line, or when three or more numbers belonging to an identical color section among colored bingo cards have lit up (see JPA-2004-105383, for example).

Such a game machine may give a bonus or credit to the player when the player has won the game, and has also been popular from such a speculative aspect.

However, since such a game machine is designed so that n game balls are discharged (released) to the game field one by one to determine whether or not the player has won the game, the play time increases. Moreover, even if a plurality of reach holes are present, it is impossible to win the game when the reach holes are situated away from each other.

A crane game that allows the player to acquire a prize using a crane device has been well-known, and very popular. However, a game that utilizes such a crane device is monotonously designed so that the player merely lifts the prize, and drops it to the acquisition point, and a game machine in which the number of game media carried by the crane device or the moving destination is incorporated as an important game element has not been proposed.

SUMMARY

Several aspects of the invention may provide a game machine in which a bingo element is incorporated, and which can reduce the game play time by implementing bingo for which the results are quickly obtained, and enables the player to simultaneously clear a plurality of reach points that are situated away from each other.

Several aspects of the invention may provide a novel game machine that combines the element ("aim and scoop") of a crane game with the game playability of bingo.

According to one aspect of the invention, there is provided a game machine that includes a plurality of game media, a housing that forms a game space that includes a determination area, and an operation section that receives an operation input performed by a player, the game machine including:

game medium release means that releases the plurality of game media to the determination area included in the game space based on the operation input from operation section;

detection means that detects the occurrence or non-occurrence of a predetermined event at a plurality of determination points provided in the determination area, the predetermined event occurring due to a released game medium among the plurality of game media; and determination means that performs a win determination process based on the occurrence or non-occurrence of the predetermined event at the plurality of determination points provided in the determination area, the determination means determining that the player has won the game when a plurality of determination points among the plurality of determination points at which the predetermined event has occurred satisfy a winning condition.

BRIEF DESCRIPTION OF THE SEVERAL VIEWS OF THE DRAWING

FIG. 13 is a diagram illustrating an example of movable range setting data.

Figure 1:
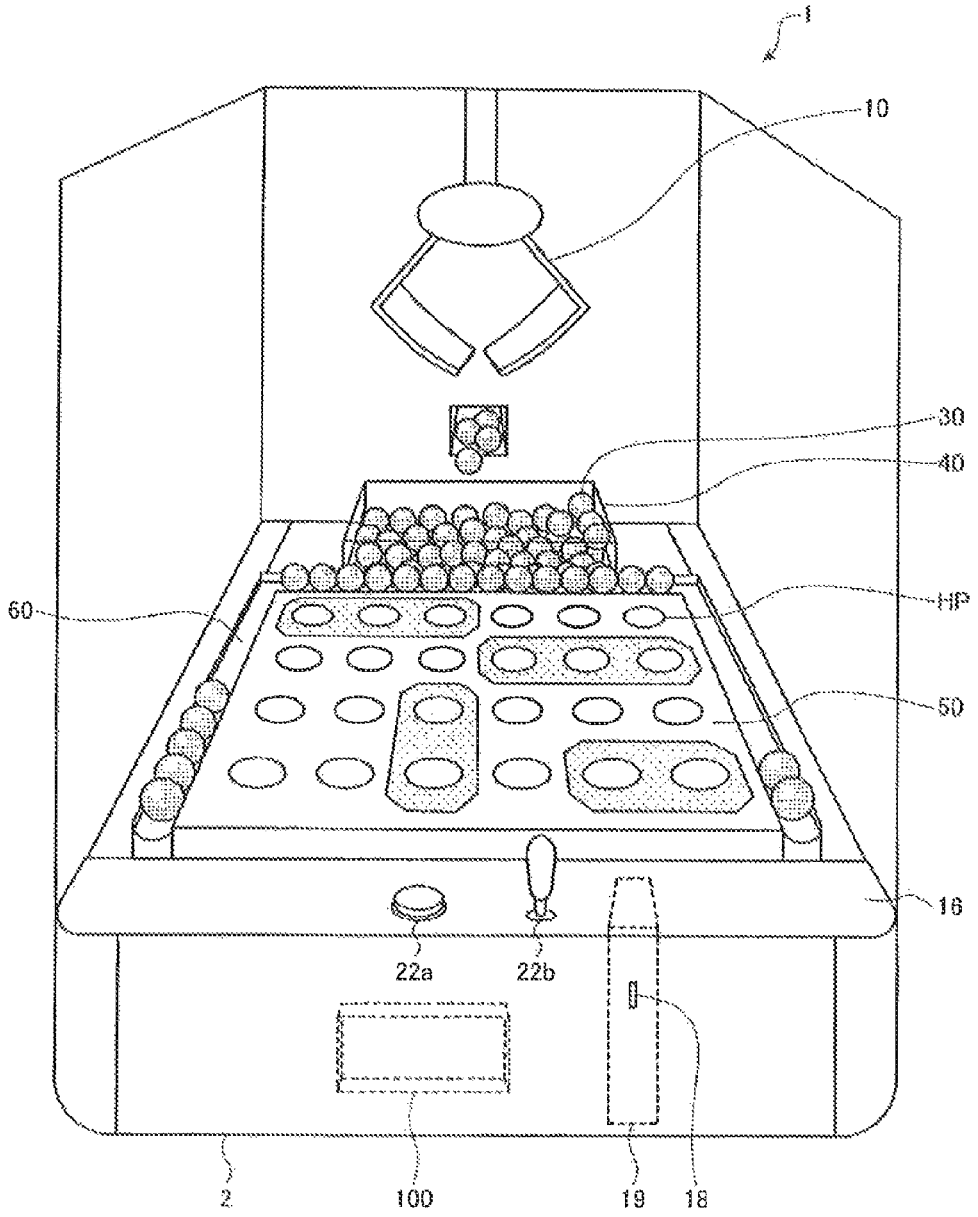
FIG. 1 is a perspective view illustrating the external appearance of a game machine according to one embodiment of the invention.

DETAILED DESCRIPTION OF THE EMBODIMENT (1) One embodiment of the invention relates to a game machine that includes a plurality of game media, a housing that forms a game space that includes a determination area, and an operation section that receives an operation input performed by a player, the game machine including: game medium release means that releases the plurality of game media to the determination area included in the game space based on the operation input from operation section; detection means that detects the occurrence or non-occurrence of a predetermined event at a plurality of determination points provided in the determination area, the predetermined event occurring due to a released game medium among the plurality of game media; and determination means that performs a win determination process based on the occurrence or non-occurrence of the predetermined event at the plurality of determination points provided in the determination area, the determination means determining that the player has won the game when a plurality of determination points among the plurality of determination points at which the predetermined event has occurred satisfy a winning condition.

The term "game medium" used herein refers to a game ball (ball), a token, a coin, a dice, and the like.

The game machine may include a means that gives a bonus to the player based on the results of the win determination process. The bonus may be in-game money, a token, an item, a bonus exchange card, a prize, electrical information, electronic data, electronic contents, or the like.

The game medium release means is configured to be able to release a plurality of game media. Note that the game medium release means may release only one game medium. Such a case is also intended to be included within the scope of the invention.

The game medium release means releases a plurality of game media to the determination area at a time based on the operation input from the operation section. A plurality of game media need not necessarily released by a single operation, but may be released by a series of operations. A plurality of game media may be released at the same time, or may be released sequentially. When a plurality of game media are released sequentially, the win determination process is performed after the plurality of game media have been released sequentially.

The player can repeatedly release the game medium according to the credit.

The determination area may be formed two-dimensionally (e.g., board surface), or may be formed three-dimensionally in part of the game space.

The occurrence or non-occurrence of the predetermined event at the determination point may be determined by detecting the placement state of the game medium at the determination point (may be determined based on the presence or absence of the game medium). For example, it may be determined that the predetermined event has occurred when the game medium is placed at the determination point. Whether or not the game medium has passed through a passage detection means (e.g., chucker) provided at the determination point, and it may be determined that the predetermined event has occurred when the game medium has passed through the passage detection means.

The predetermined event may be placement, passage, or collision of the game medium with respect to the determination point.

The detection means may detect the placement position of the game medium in the determination area by capturing the determination area using a CCD camera or the like to determine whether or not the predetermined event has occurred at the determination point. The occurrence or non-occurrence of the predetermined event may be detected by providing a sensor or the like that detects passage or placement of the game medium in the determination area.

The winning condition may be specified by the positional relationship between a plurality of determination points at which the predetermined event has occurred, and it may be determined that the player has won the game when a plurality of determination points at which the predetermined event has occurred satisfy a predetermined positional relationship. The winning condition may be specified by a combination (set) of a plurality of determination points at which the predetermined event has occurred, and it may be determined that the player has won the game when the predetermined event has occurred at a plurality of determination points specified by the combination.

The determination means may perform the win determination process each time the game medium is released.

A plurality of different winning conditions may be provided. According to one embodiment of the invention, since a plurality of game media are released at a time, the player can satisfy a plurality of winning conditions by performing a single release operation. For example, since a known bingo game is designed so that double reach, triple reach, and the like are limited to the case where one point has satisfied a plurality of reach conditions, a known bingo game cannot implement a game in which the player can achieve multiple winning by performing a single release operation. Since it is possible to cause the predetermined event to occur at the same time at a plurality of determination points that are situated apart from each other when a plurality of game media are released at a time, the player can achieve multiple winning by performing a single release operation. This makes it possible to motivate the player to player the game with a high degree of expectation of winning.

According to one embodiment of the invention, since a plurality of game media are released at a time, the number of release operations performed until whether or not the player wins the game is determined decreases (the game play time decreases), and the game utilization rate can be improved.

(2) In the game machine, the plurality of determination points may be configured so that the released game medium can be placed, and the detection means may detect that the predetermined event has occurred at a determination point among the plurality of determination points when the released game medium is placed at the determination point.

Since the win determination process is performed based on the actual placement of the game medium, it is possible to allow the player to enjoy a more realistic game. Since a situation occurs in which the released game medium collides with the game medium that has been placed in the determination area to change the position of the game medium, for example, it is possible to allow the player to enjoy a game that has a wide variation of scope.

(3) In the game machine, the game medium release means may determine a release position within the determination area based on the operation input from the operation section, and release the game medium at the determined release position.

The game medium release means may be implemented by a crane device employed for a crane game machine, for example. This makes it possible to provide a novel game machine that allows the player to designate the release position of the crane device so that the predetermined event occurs at the determination point.

(4) In the game machine, a game medium storage section may be provided in the game space, game media among the plurality of game media being placed in the game medium storage section, and the game medium release means may include catch means that catches the game media placed in the game medium storage section based on the operation input from the operation section, and releases the game media caught by the catch means to the determination area.

The catch means may be an arm of a crane device, a device that catches the game medium using an electromagnet or the like, a vacuum device, or the like. This makes it possible to provide a novel game machine that combines the element ("aim and scoop") of a crane game with the game playability of bingo.

(5) The game machine may further include first reset means that resets the predetermined event that has occurred at the plurality of determination points that have satisfied the winning condition after the determination means has performed the win determination process.

When the plurality of determination points are configured so that the released game medium can be placed, and the detection means detects that the predetermined event has occurred at a determination point among the plurality of determination points when the released game medium is placed at the determination point, the first reset means may remove the game media placed at the plurality of determination points that have satisfied the winning condition from the plurality of determination points after the determination means has performed the win determination process.

The removed game medium may be discharged to the game medium storage section.

When the game medium is placed at the determination point, the number of game media placed on the hoard surface increases, and the number of determination points at which the game medium can be placed decreases. In this case, the player cannot fully enjoy releasing and placing the game medium at the determination point. According to the above configuration, since a plurality of determination points that have satisfied the winning condition are reset (the placement state of the game medium is canceled), the player can enjoy releasing and placing the game medium at the determination point.

(6) In the game machine, a winning determination point at which the predetermined event must occur in order to satisfy the winning condition, and a non-winning determination point may be set to the determination area, and the game machine may further include second reset means that removes a game medium among the plurality of game media placed at the non-winning determination point from the non-winning determination point after the determination means has performed the win determination process.

The removed game medium may be discharged to the game medium storage section.

The non-winning determination point is not defined to satisfy the winning condition. Note that a bonus or points may be given to the player when the game medium has been placed at the non-winning determination point. Points or the like may be given to the player when the predetermined event has occurred at the determination point independently of whether the determination point is the winning determination point or the non-winning determination point.

When the game medium is placed at the determination point, the number of game media placed on the board surface increases, and the number of determination points at which the game medium can be placed decreases. In this case, the player cannot fully enjoy releasing and placing the game medium at the determination point. According to the above configuration, since the game medium placed at the non-winning determination point is removed (reset) (the placement state of the game medium is canceled), the player can enjoy releasing and placing the game medium at the determination point.

(7) The game machine may further include automatic play control means that determines whether or not the occurrence or non-occurrence of the predetermined event at a determination point among the plurality of determination points satisfies a predetermined condition when the player does not play the game, and releases the game medium to the determination area independently of the operation input performed by the player when it has been determined that the predetermined condition is satisfied.

An attraction process is performed when the player does not play the game, for example. According to the above configuration, the hit state of the determination point in the determination area can be adjusted while achieving an attraction effect during the attraction process or the like. It is possible to highly motivate the player to start the game by creating a situation in which the player can nearly win the game.

(8) In the game machine, a retention area in which the released game medium can retained may be provided along part of an outer edge of the determination area included in the game space.

For example, when the determination area is formed by a board surface, the game medium released to the board surface fails from the board surface when the game medium is not placed at the determination point. When the retention area is provided, some of the game media that fall from the determination area (board surface) are retained by the retention area.

The game media retained by the retention area serve as a wall formed along the outer edge of the determination area, and the game medium that moves on the determination area collides with and is bounced from the game media retained by the retention area, and move on the determination area. This makes it possible to increase the possibility that the predetermined event occurs.

(9) The game machine may further include difficulty level adjustment means that adjusts a difficulty level based on historical information about results of the win determination process.

The historical information about results of the win determination process may be statistical information about the results of the win determination process for a predetermined past period (e.g., x hours).

The historical information may be compared with a specific reference to adjust the difficulty level.

Exemplary embodiments of the invention are described below. Note that the following exemplary embodiments do not unduly limit the scope of the invention as stated in the claims. Note also that all of the elements described below in connection with the following exemplary embodiments should not necessarily be taken as essential elements of the invention.

1. Configuration 1-1. Configuration diagram

Figure 2:
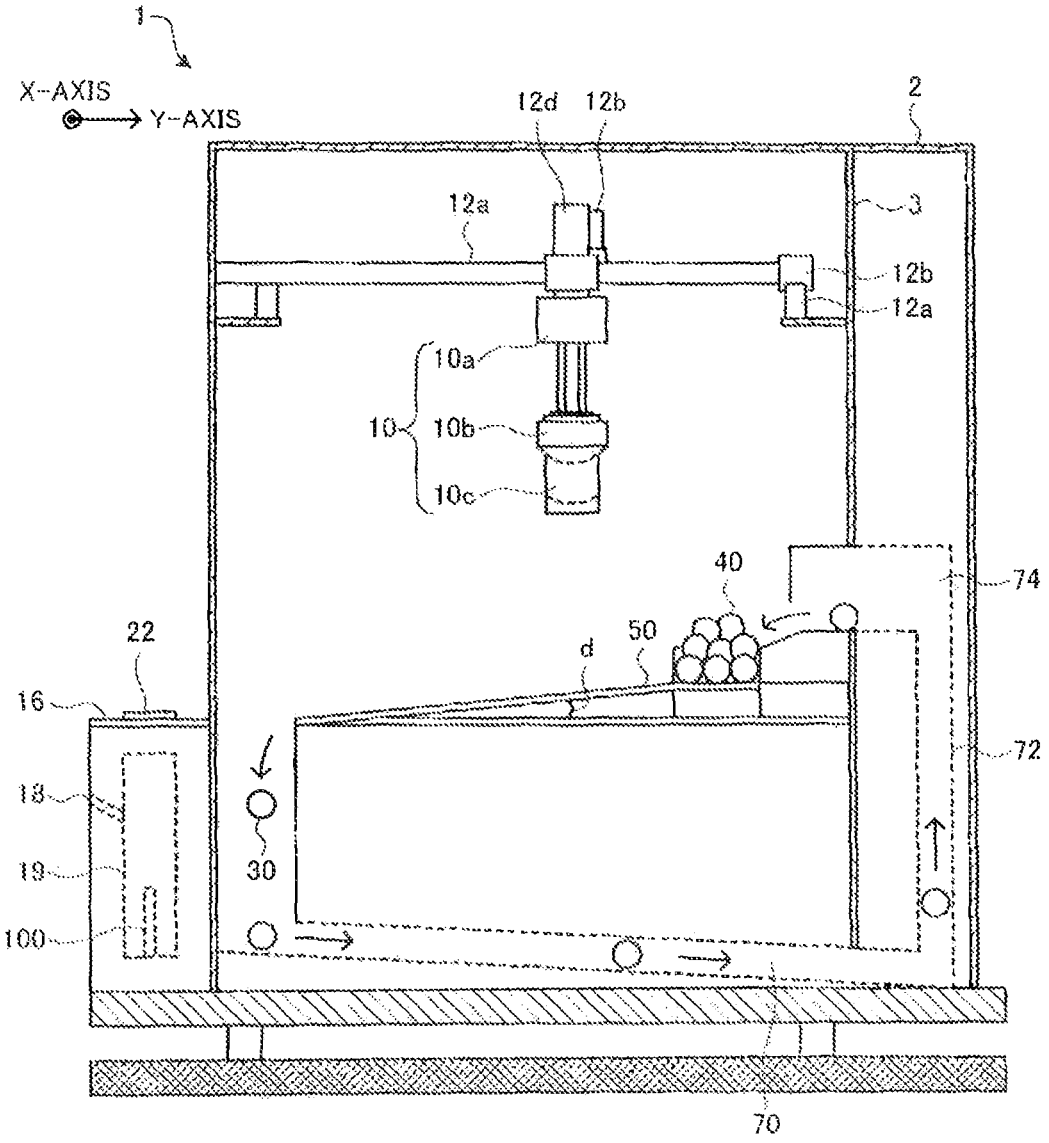
FIG. 2 is a cross-sectional view illustrating part of a game machine according to one embodiment of the invention.
Figure 3:
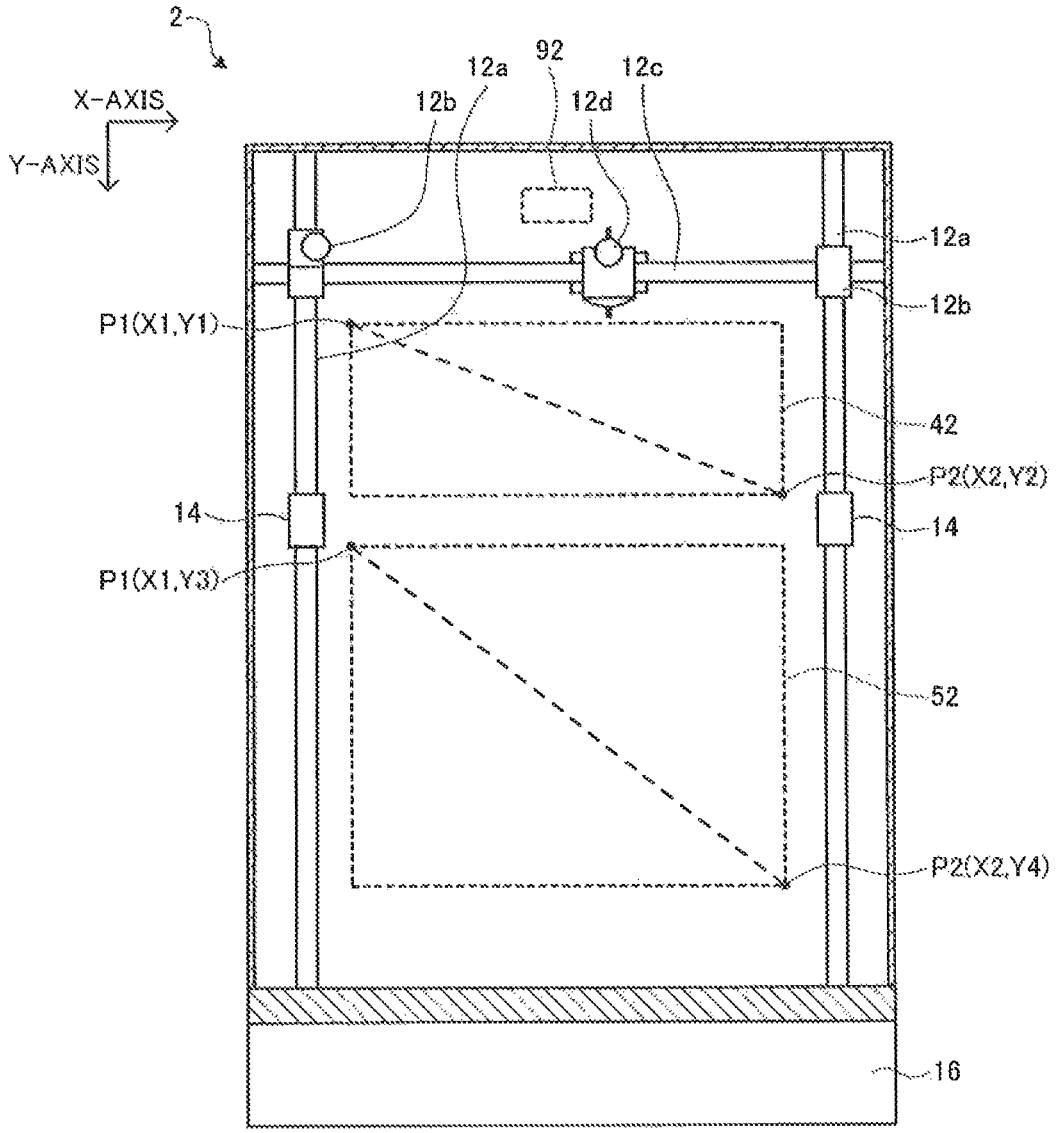
FIG. 3 is a top perspective view illustrating part of a game machine according to one embodiment of the invention.

FIG. 1 is a perspective view illustrating the external appearance of a game machine 1 according to one embodiment of the invention. FIGS. 2 and 3 are respectively a vertical cross-sectional view and a top perspective view illustrating a configuration example of the game machine 1 according to one embodiment of the invention.

The game machine 1 according to one embodiment of the invention implements a game in which a game ball 30 (i.e., game medium) held by a crane device 10 is moved, and released over a board surface 50 (i.e., determination area) to place the game ball 30 at a determination point HP (i.e., a position or an area for determining the presence or absence of placement of the released game ball (e.g., a hole, a recess, a groove, or the like in which the game ball can be placed)) that is provided on the board surface 50.

The upper part of the front face of and each side face of a housing 2 of the game machine 1 is formed of a transparent acrylic plate, a transparent glass plate, or the like so that the player can observe a game space formed inside the housing 2, and cannot touch the inside of the housing 2. In one embodiment of the invention, the internal space of the housing 2 functions as the game space.

The board surface 50 on which a plurality of determination points HP (i.e., determination areas) are provided in the game space the plurality of determination points HP being configured so that play ball 30 can be placed therein.

A game ball storage section 40 in which the game balls 30 are accumulated is provided inside the game space on the interior side of the board surface 50.

As illustrated in FIG. 2, the board surface 50 is disposed to slope with respect to the horizontal plane so that the front side is lower than the back side with respect to the player. The slope alpha of the board surface can be controlled by a board surface slope control motor 52 (not illustrated in the drawings).

A ball retention section 60 (i.e., retention area) that retains the game balls 30 is provided around the outer edge of the board surface 50. The game ball 30 that has been released into the game space from the crane device 10 rolls on the board surface 50, and enters the determination point HP provided on the board surface 50 (i.e., is placed at the determination point HP), or enters the ball retention section 60 across the outer edge of the board surface 50 (i.e., is retained in the ball retention section 60), or falls from the board surface 50 onto the lower part of the housing.

As illustrated in FIG. 2, a back face 3 is vertical provided on the back side of the game space inside the housing 2, and a moving path 70 (along which the game ball 30 that has fallen from the board surface 50 moves), a moving lift 72, and an internal storage section 74 are provided in the lower part of the housing 2 and behind the back face 3. The game ball 30 that has fallen onto the lower part of the housing moves along the moving path 70, is moved upward by the moving lift 72 to reach the internal storage section 74, and is discharged to the game ball storage section 40.

The crane device 10 (i.e., game medium release means) and an XY stage 12 (i.e., game medium release means) are provided in the upper part of the game space, the crane device 10 holding and moving a plurality of game balls 30 inside the game space, and releasing the plurality of game balls 30, and the XY stage 12 moving the crane device 10 approximately horizontally inside the game space above the hoard surface 50 and the game ball storage section 40. A control board 100 that electronically controls the crane device 10 and the XY stage 12 is provided in the housing 2. The crane device 10, the XY stage 12, and the control board 100 function as a game medium release means.

The XY stage 12 is a linear motion stage that is controlled by the control hoard 100 corresponding to a stage movement operation performed by the player. The XY stage 12 is implemented by a gantry stage, for example.

Specifically, the XY stage 12 includes a pair of Y-axis rails 12*a* that are parallel to an approximately horizontal rightward/leftward direction of the game machine 1, and a pair of Y-axis sliders 12*b* that can slidably move respectively along the pair of Y-axis rails 12*a*. Note that the X-axis direction is the rightward/leftward direction with respect to the front side of the game machine 1 (the rightward direction is a positive direction), and the Y-axis direction is the forward/backward direction with respect to the front side of the game machine 1 (the backward direction is a positive direction) (see FIG. 3). The Y-axis rail 12*a* extends approximately in the backward direction of the game machine 1. The positive Y-axis direction is the backward direction. At least one of the pairs of the Y-axis sliders 12*b* includes a driver section that drives with respect to the Y-axis rail 12*a* under electronic control of the control board 100, and a position detection means that detects the relative position with respect to a specific reference position of the Y-axis rail 12*a*. The position detection means is implemented by a range sensor, a driver section rotational speed counter, or the like. Position detection information detected by the position detection means is fed hack to the control board 100.

The XY stage 12 further includes an X-axis rail 12*c* that is provided to connect the pair of Y-axis sliders 12*b*, and an X-axis slider 12*d* that can move along the X-axis rail 12*c*. The X-axis rail 12*c* perpendicularly intersects the Y-axis rail 12*a*. The X-axis rail 12*c* extends approximately in the horizontal direction of the game machine 1. The X-axis slider 12*d* is configured in the same manner as the Y-axis slider 12*h*. The X-axis slider 12*d* can slidably and positionably move with respect to a specific reference position of the X-axis rail 12*c* under control of the control board 100.

As illustrated in FIGS. 2 and 3, the crane device 10 has a configuration in which a crane base 10*a* that includes a driver device and the like is suspended from the X-axis slider 12*d*. A crane head 10*b* can be moved upward and downward, and a game medium holding arm 10*c* provided to the crane head 10*b* can be opened and closed under electronic control of the control board 100.

The crane device 10 is moved from a reference position 18 to a desired position in an area 42 above the game ball storage section 40 using the XY stage 12 corresponding to a first moving operation performed by the player (movement control). After completion of movement control, the crane head 10*b* is moved downward to approach the game ball storage section 40 using the XY stage 12 in a state in which the game medium holding arm 10*c* is opened (downward movement control).

The game medium holding arm 10*c* of the crane device 10 is then closed using the XY stage 12 (holding control), and the crane head 10*b* is moved upward (upward movement control). Since the game medium holding arm 10*c* can hold a plurality of game balls 30 at a time, it is possible to catch a plurality of game balls 30 by a series of control implemented by the first moving operation.

After completion of the series of control implemented by the first moving operation, the crane device 10 is moved to a desired position over an area 52 using the XY stage 12 corresponding to a second moving operation performed by the player in a state in which the game balls are held by the game medium holding arm 10*c*.

After completion of movement control, the crane head 10*b* is moved downward to approach the board surface 50 using the XY stage 12 (downward movement control), and the game medium holding arm 10*c* is opened (release control). The game balls held by the game medium holding arm 10*e* are thus released to the board surface 50.

According to one embodiment of the invention, the game balls are released from the crane device by a series of control implemented corresponding to the first moving operation and the second moving operation, and a plurality of play balls are released to the board surface by a single release operation.

The game machine 1 includes a slider stopper 14 that is provided in the upper part of the game space, and is situated above the boundary between the game ball storage section 40 and the board surface 50. The movement of the crane device 10 in the Y-axis direction can thus be limited.

As illustrated in FIG. 1, the game machine 1 includes a console 16 that is provided on the front side of the game machine 1. The console 16 is provided with a coin insertion slot 18 for inserting a coin (game play charge), and an operation section 22 (operation button 22*a* and operation lever 22*b*) for inputting a game operation.

A coin inserted into the coin insertion slot 18 is detected and received by a coin counter 19 provided in the console 16. The coin counter 19 is a device that detects insertion of a coin, and outputs a detection signal to the control board 100. The coin insertion slot 18 and the coin counter 19 may be replaced with a prepaid card/credit card insertion slot and a prepaid card/credit card reader/writer. The coin insertion slot 18 and the coin counter 19 may be provided in combination with a prepaid card/credit card insertion slot and a prepaid card/credit card reader/writer.

The first moving operation and the second moving operation are input using the operation section 22 (operation button 22*a* and operation lever 22*b*).

Each of the first moving operation and the second moving operation can be performed only once in the positive X-axis direction (rightward direction) and the positive Y-axis direction (backward direction). For example, the player instructs the start of the first moving operation by pressing the operation button 22*a*, moves the crane device 10 to a position above the game ball storage section by the operating the operation lever 22*b* to catch the game ball, and moves the crane device 10 to a position above the hoard surface by the operating the operation lever 22*b* to release the game ball.

More specifically, the XY stage 12 maintains the crane device 10 at a predetermined home position (92 in FIG. 3) when the game has started. When the player has pressed the operation button 22*a*, and operated the operation lever 22*b* in the forward, backward, rightward, or leftward direction, the XY stage 12 moves the crane device 10 in the forward, backward, rightward, or leftward direction. The crane device 10 stops when the operation lever 22*b* has been released. When the movement in the Y-axis direction and the movement in the X-axis direction have completed, the crane device 10 automatically performs a catch operation. Specifically, the crane device 10 moves downward in a state in which the game medium holding arm 10*c* is opened. The game medium holding arm 10*e* is closed when the crane device 10 has reached the lower limit, and the crane device 10 then moves upward.

When the player has operated the operation lever 22*b* in the forward, backward, rightward, or leftward direction, the XY stage 12 moves the crane device 10 in the forward, backward, rightward, or leftward direction. The crane device 10 stops when the operation lever 22*b* has been released. When the movement in the Y-axis direction and the movement in the X-axis direction have completed, the crane device 10 automatically releases the game ball. Specifically, the XY stage 12 is controlled to open the game medium holding arm 10*c* of the crane device 10 to release the game ball, and return the crane device 10 to the initial position.

Note that the number and the type of the operation button 22*a* and the operation lever 22*b* are not limited to those described above. The number and the type of the operation button 22*a* and the operation lever 22*b* may be appropriately set corresponding to the game rule. For example, a trigger button for inputting the start of the second moving operation may be additionally provided, or a Y-axis direction movement button and an X-axis direction movement button may be provided instead of the operation lever (joystick), or a lever other than a joystick, a dial, a touch panel, or the like may be used.

In the game machine 1 according to one embodiment of the invention, the control board 100 provided in the console 16 executes a predetermined control program to electronically control the operation of each section of the game machine 1 to integrally control the game.

1-2. Hardware Configuration Example

Figure 4:
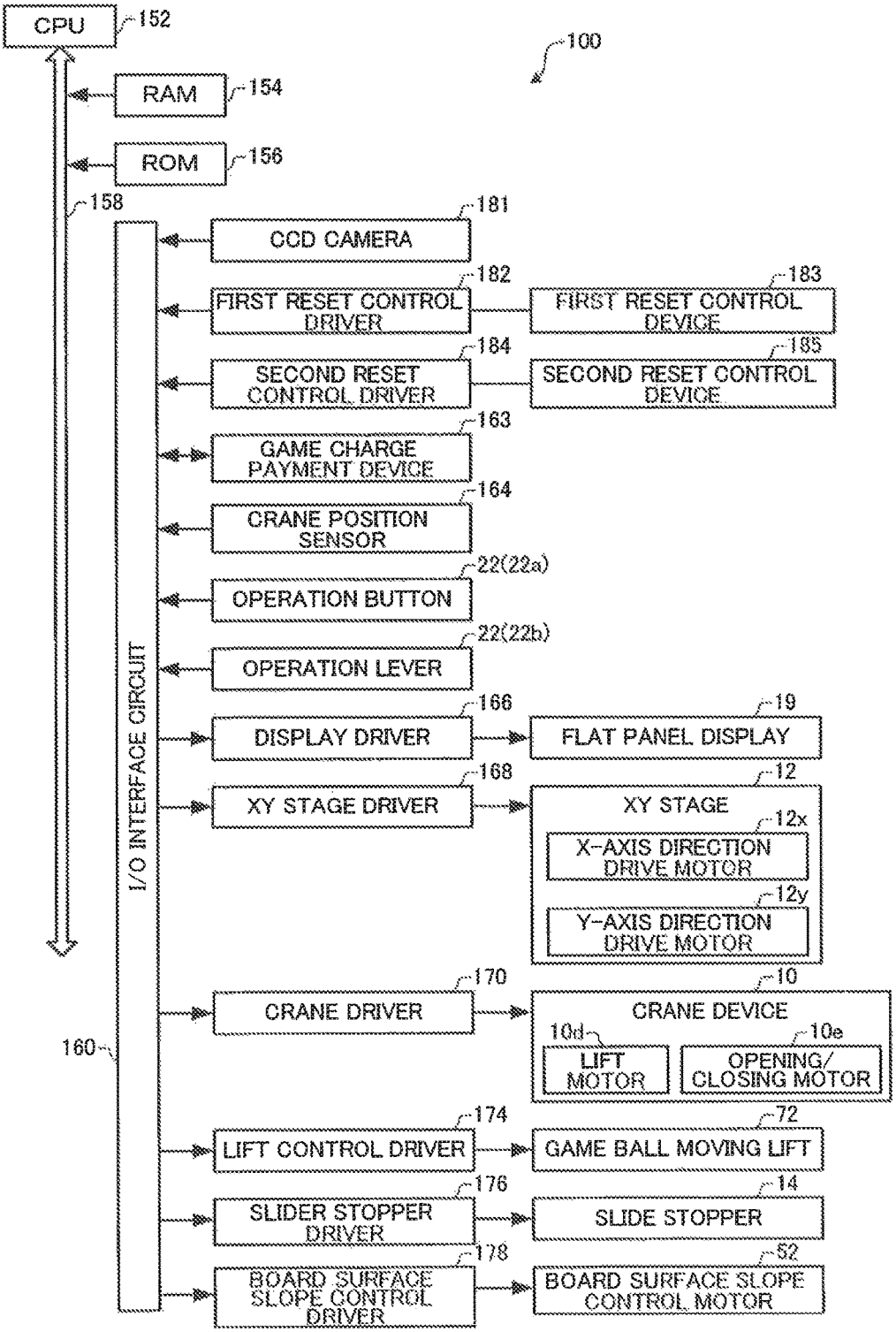
FIG. 4 is a hardware block diagram according to one embodiment of the invention.

FIG. 4 illustrates a hardware configuration example (i.e., electronic/electrical hardware connection relationship) according to one embodiment of the invention.

The control board 100 includes a central processing unit (CPU) 152, and IC memories such as a RAM 154 and a ROM 156. The CPU 152, the RAM 154, and the ROM 156 are electrically connected through a bus circuit 158 so that data can be read and written, and signal can be exchanged therebetween.

A game charge payment device 163, a crane position sensor 164, an operation button 22 (22*a*), and an operation lever 22 (22*b*) are connected to the bus circuit 158 through an I/O interface circuit 160.

The I/O interface circuit 160 is a signal relay circuit for various input/output sections. The I/O interface circuit 160 may include a plurality of types of I/O interface IC that generates a signal in conformity with the standard of each input/output section connected thereto, for example.

The game charge payment device 163 is a device that allows the player to make a payment for playing the game. In the example illustrated in FIG. 1, the coin counter 19 corresponds to the game charge payment device 163. When the game machine 1 is configured so that the player can make a payment via a prepaid card, a credit card, or electronic money, a card (recording medium) reader/writer corresponds to the game charge payment device 163. Note that game play charge points may be recorded in the card (recording medium) (e.g., 10 points per 100 yen), and game points (e.g., 10 points) may be given to the player in exchange for a payment of 10 points. In this case, the point exchange rate may be appropriately determined.

The crane position sensor 164 detects the current coordinates of the X-axis slider 12*b* and the Y-axis slider 12*d* with respect to the reference position of the XY stage 12, for example. The crane position sensor 164 is implemented by a rotary encoder, a range sensor, or a drive system gear/pulley rotation sensor, for example.

A CCD camera 181 is provided at a position at which the board surface 50 can be captured, for example. The presence or absence of placement (predetermined event) of the game ball in the plurality of determination points HP provided on the board surface 50 is detected based on an image captured by the CCD camera 181.

The CPU 152 acquires the current digital switch setting value, position coordinate information about the crane device 10, and information about an operation input performed on the operation button 22*a* or the operation lever 22*h* through the I/O interface circuit 160.

A first reset control driver 182, a second reset control driver 184, an XY stage driver 168, a crane driver 170, a lift control driver 174, a slider stopper driver 176, and a board surface slope control driver 178 are electrically connected through the I/O interface circuit 160.

The term "driver" used herein refers to an electronic device/circuit that can generate/output a control signal for driving (controlling) a driven device such as display device or a motor corresponding to a control signal output from the CPU 152.

Specifically, the first reset control driver 182 generates a first reset drive signal that causes a first reset control section 183 to remove the game ball placed in the hole corresponding to the determination point that has satisfied the winning condition from the determination point based on the control signal output from the CPU 152.

The second reset control driver 184 generates a second reset drive signal that causes a second reset control section 185 to remove the game ball placed in the hole corresponding to the non-winning point based on the control signal output from the CPU 152.

A display driver 166 generates a drive signal that causes a flat panel display (not illustrated in the drawings) to display an image based on the control signal output from the CPU 152.

The XY stage driver 168 generates a drive signal that drives an X-axis direction drive motor 12*x* included in the X-axis slider 12*b*, and a Y-axis direction drive motor 12*y* included in the Y-axis slider 12*d*.

The crane driver 170 generates a drive signal that drives a lift motor 10*d* that drives the crane head 10*b* of the crane device 10, and an opening/closing motor 10*e* that drives the game medium holding arm 10*c* of the crane device 10. The lift control driver 174 generates a drive signal that drives a lift motor that drives the play ball moving lift 72.

The slider stopper driver 76 generates a signal that drives a slide stopper 14.

The board surface slope control driver 178 generates a control signal that causes the hoard surface slope control motor 52 to change the slope of the board surface based on the control signal output from the CPU 152.

The calculation device included in the control board 100 is not limited to the CPU 152. The control board 100 may appropriately include various microprocessors such as a graphics processing unit (GPU) and a digital signal processor (DSP). The control board 100 may include an application-specific integrated circuit (ASIC). Note that the IC memories (e.g., RAM 154 and ROM 156) may appropriately include an application-specific RAM (e.g., VRAM), a flash memory, and the like.

1-3. Functional Blocks

Figure 5:
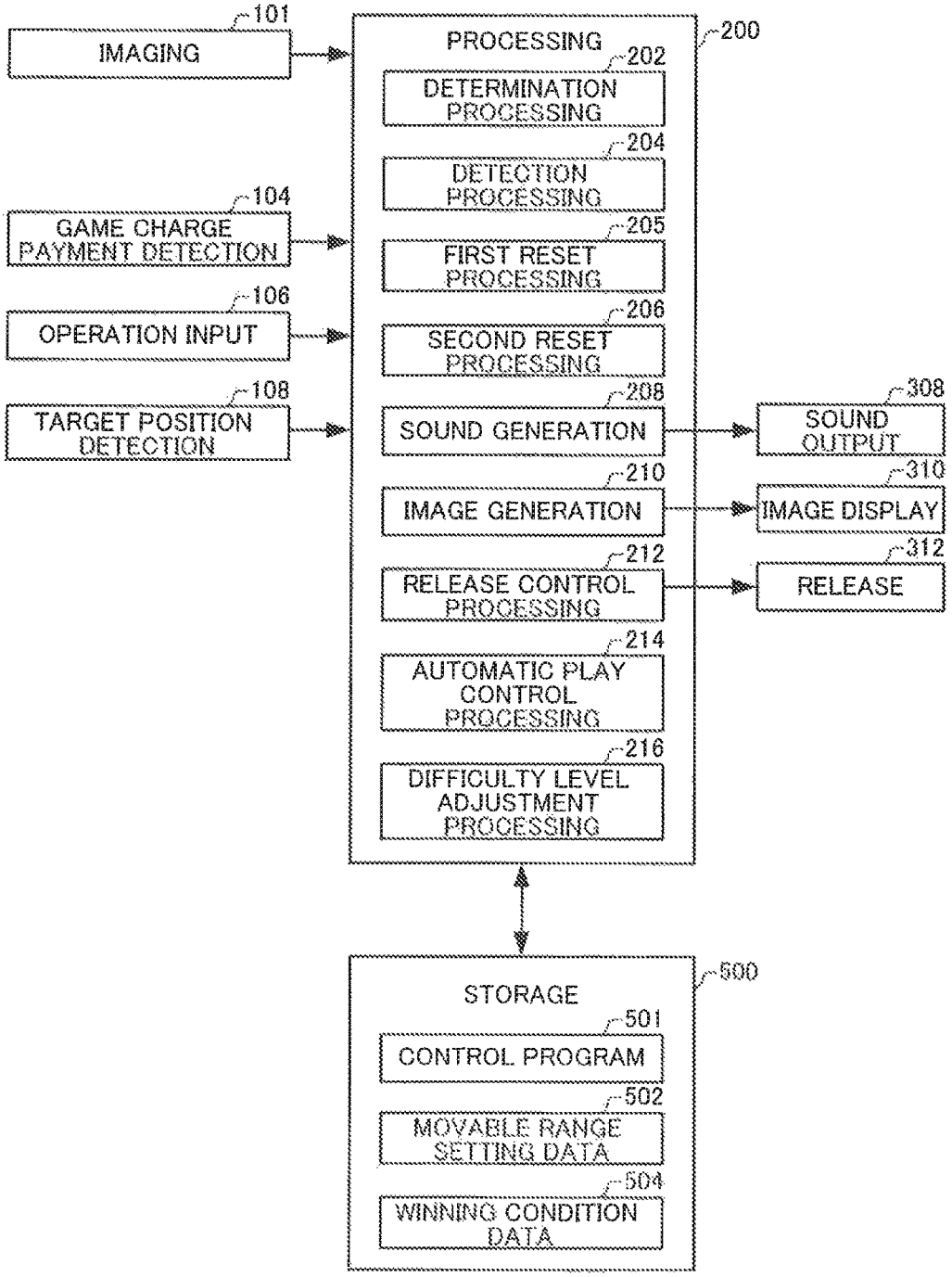
FIG. 5 is a functional block diagram according to one embodiment of the invention.

FIG. 5 is a functional block illustrating a functional configuration example of the game machine 1.

The game machine 1 includes an imaging section 181" (corresponding to the CCD camera 181 in FIG. 4), a game charge payment detection section 104 (corresponding to the game charge payment device 163 in FIG. 4), an operation input section 106, a target position detection section 108, a processing section 200, a sound output section 308, an image display section 310, and a release section 312.

The game charge payment detection section 104 detects payment of the game charge, and outputs a detection signal to the processing section 200. For example, the coin counter 19 in FIG. 1 corresponds to the game charge payment detection section 104. When the game machine 1 is configured so that the player can make a payment via a prepaid card, a credit card, or electronic money, a reader/writer that can read or write information from or into such a card or an IC chip or the like that stores electronic money information corresponds to the game charge payment detection section 104.

The operation input section 106 receives an operation input (first operation input or second operation input) that causes the game ball to be held, moved, and released to the board surface. In one embodiment of the invention, the operation button 22*a* and the operation lever 22*b* (see FIG. 1) that allows the player to perform an operation input that moves the crane device 10. The operation input section 106 may be implemented by a push switch, a joystick, a touch pad, a trackball, and the like.

The target position detection section 108 detects the target position of the crane device 10. When the game ball is caught and released by moving the crane device 10 as described above, the target position detection section 108 detects the catch position and the discharge position of the play ball. The crane position sensor 164 that detects the positions of the X-axis slider 12*b* and the Y-axis slider 12*d* included in the XY stage 12 illustrated in FIG. 1 corresponds to the target position detection section 108, for example.

The processing section 200 is implemented by electronic parts such as a microprocessor (e.g., CPU or GPU), an ASIC, and an IC memory. The processing section 200 controls data input/output between each functional section (e.g., operation input section 106 and storage section 500). The processing section 200 performs various calculation processes based on a predetermined program, data, and an operation input signal output from the operation input section 106 to control the operation of the game machine 1. The control board 100 illustrated in FIG. 1 corresponds to the processing section 200.

The processing section 200 performs various game control processes, and includes a determination processing section 202, a detection processing section 204, a first reset processing section 205, a second reset processing section 206, a sound generation section 208, an image generation section 210, a release control processing section 212, an automatic play control processing section 214, and a difficulty level adjustment processing section 216.

The release control processing section 212 performs a control process that releases a plurality of game media to the determination area in the game space based on an operation input from the operation section.

The detection processing section 204 performs a process that detects the occurrence or non-occurrence of a predetermined event (i.e., the presence or absence of the hit) with respect to a plurality of determination points provided in the determination area using a detection means. In one embodiment of the invention, the determination area is captured using the imaging section 181 (e.g., CCD camera) as the detection means, and the placement position of the game medium in the determination area is analyzed from the captured image to detect the position of the determination point at which the predetermined event has occurred. Note that a detection means (e.g., sensor) that detects the presence or absence of placement, passage, collision (hitting), or contact of the game medium may be provided to the determination area, and the position (hit position) of the determination point at which the predetermined event has occurred may be detected using the detection means.

The determination processing section 202 performs a win determination process based on the occurrence or non-occurrence of the predetermined event at a plurality of determination points in the determination area. The determination processing section 202 determines that the player has won the game when a plurality of determination points at which the predetermined event has occurred satisfy the winning condition.

The detection processing section 204 may detect that the predetermined event has occurred when the released game medium is placed at the determination point.

The release control processing section 212 performs the control process that determines the release position within the determination area based on an operation input from the operation section, and releases the game medium at the determined release position.

The release control processing section 212 may perform the control process that catches the game medium placed in the game medium storage section based on an operation input from the operation section, and releases the caught game medium to the determination area.

The first reset processing section 205 performs a process that resets the predetermined event that has occurred at a plurality of determination points that have satisfied the winning condition after the win determination process has been performed.

The second reset processing section 206 performs a process that removes the game medium placed at the non-winning determination point from the non-winning determination point after the win determination process has been performed.

The automatic play control processing section 214 performs a control process that determines whether or not the occurrence or non-occurrence of the predetermined event at the determination point satisfies a predetermined condition when the player does not play the game, and releases the game medium to the determination area independently of an operation input performed by the player when it has been determined that the predetermined condition is satisfied.

The difficulty level adjustment processing section 216 performs a process that adjusts the difficulty level based on historical information about the results of the win determination process.

In one embodiment of the invention, the processing section 200 includes a sound generation section 208 that generates a sound signal for the sound output section 308 to output a sound notification, and an image generation section 210 that generates an image signal for the image display section 310 to output a light notification.

The sound generation section 208 is implemented by a processor (e.g., digital signal processor (DSP) or sound synthesis IC), an audio codec that can play a sound file, or the like. The sound generation section 208 generates the sound signal (e.g., an announcement sound signal that reads the target determination result corresponding to each prize placement stage), and outputs the sound signal to the sound output section 308. The sound output section 308 is implemented by a device that outputs sound (e.g., effect sound or background music (BGM) based on the sound signal input from the sound generation section 208. The speaker 40 illustrated in FIG. 1 corresponds to the sound output section 308.

The image generation section 210 is implemented by a processor (e.g., GPU or DSP)), a video signal IC, a program (e.g., video codec), a drawing frame IC memory (e.g., frame buffer), or the like. The image generation section 210 generates an image that displays the determination point notification or the winning result on the board surface, and outputs an image signal of the generated image to the image display section 310. The image display section 310 displays a game image based on the image signal input from the image generation section 210. The image display section 310 is implemented by an image display device such as a flat panel display, a cathode-ray tube (CRT), a projector, or a head-mounted display. In one embodiment of the invention, the flat panel display illustrated in FIG. 1 corresponds to the image display section 310. When illuminations that light up the target determination result are provided instead of the flat panel display, the state of the illuminations are controlled.

The release control processing section 212 outputs an operation control signal that causes the release section 312 to operate according to the operation input signal from the operation input section 106.

The release section 312 is a means that catches, transfers, and releases the game ball placed in the game ball storage section. The crane device 10 and the XY stage 12 function as the release section 312.

The storage section 500 stores a program, data, and the like. The storage section 500 is used as a work area for the processing section 200, and temporarily stores the results of calculations performed by the processing section 200 according to a program, data input from the operation input section 100, and the like. The function of the storage section 500 is implemented by an IC memory (e.g., RAM or ROM), a magnetic disk (e.g., hard disk), an optical disk (e.g., CD-ROM or DVD), or the like. The IC memory included in the control board 100 illustrated in FIG. 1 corresponds to the storage section 500.

In one embodiment of the invention, a control program 501 for implementing various functions for integrally controlling the game machine 1, movable range setting data 502, and winning condition data 504 are stored in the storage section 500 in advance.

FIG. 13 is a diagram illustrating an example of the movable range setting data 502.

The movable range setting data 502 is data that defines the movable range of the release section 312. In one embodiment of the invention, the movable range setting data 502 defines a two-dimensional area that represents the movable range with respect to the game ball storage section and the board surface. For example, movable range coordinates 502*b* may be stored corresponding to an area ID (game ball storage section ID and board surface ID) (see FIG. 13). Since the game ball storage section and the board surface are have a quadrangular shape when viewed from above, the coordinates of the diagonal points of the game ball storage section and the board surface may be stored as the movable range coordinates. For example, the coordinates P1(X1, Y1) and P2(X2, Y2) of the diagonal points of the game ball storage section (game ball storage area) (42 in FIG. 3) may be stored corresponding to the game ball storage section ID. The coordinates P3(X1, Y3) and P4(X2, Y4) of the diagonal points of the board surface (board surface area) (52 in FIG. 3) may be stored corresponding to the board surface ID.

The coordinate system of the movable range coordinates is linked to the coordinate system used to control the movement of the release section 312 (i.e., the coordinate system of the position detected by the target position detection section 108). The coordinate system of the movable range coordinates may be linked to the coordinate system of each slider of the XY stage 12.

2. Process 2-1. Win Determination Process

In one embodiment of the invention, the win determination process is performed based on the occurrence or non-occurrence of the predetermined event of the released game ball (i.e., game medium) at the plurality of determination points provided on the board surface. It is determined that the player has won the game when a plurality of determination points at which the predetermined event has occurred satisfies the winning condition. Note that a state in which the predetermined event has occurred is referred to as "hit state".

The following description is given taking an example in which the game ball can be placed at the determination point, and the determination point is detected to be in the hit state when the released play ball is placed at the determination point.

Figures 6A, 6B:
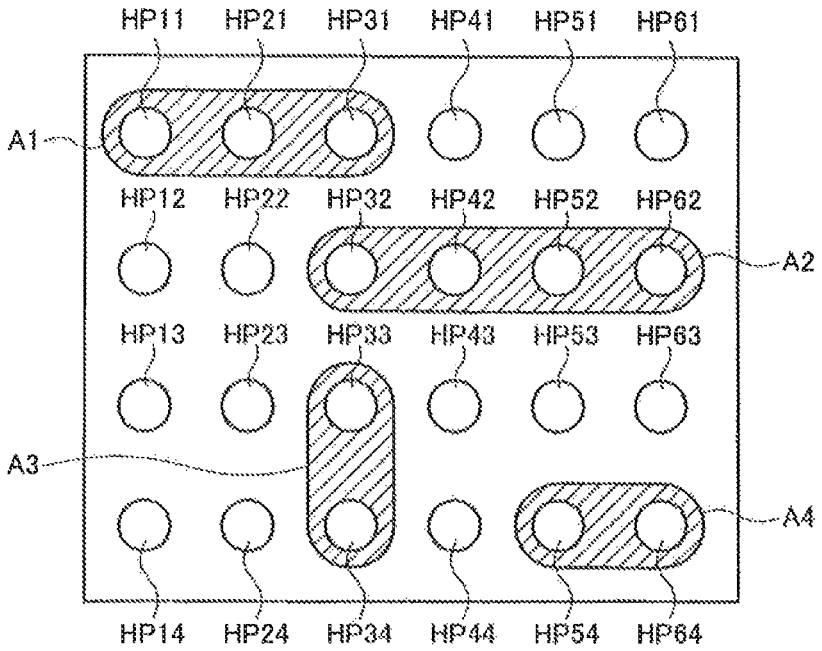
FIGS. 6A and 6B illustrate an example of a win determination process according to one embodiment of the invention.

FIGS. 6A and 6B illustrate an example of the win determination process according to one embodiment of the invention.

FIG. 6A illustrates an example of the determination points HP provided on the board surface (i.e., determination area), and FIG. 6B illustrates an example of the winning condition data.

The determination point HP is a position or an area for determining whether or not the released game ball has hit the board surface. The determination point HP is formed as a hole, a recess, a groove, or the like where the game ball can be placed. The following description is given taking an example in which a state in which the released game ball is placed at the determination point HP is detected as the hit state. Note that the configuration is not limited thereto. For example, the determination point may be configured so that the game ball passes through, and the determination point may be detected to be in the hit state when the play ball has passed through the determination point.

In one embodiment of the invention, whether or not the positional relationship between a plurality of determination points detected to be in the hit state, or a combination of a plurality of determination points detected to be in the hit state, satisfies the winning condition is determined.

In FIG. 6A, the areas A1, A2, A3, and A4 are displayed as a set (combination) of determination points that satisfies the winning condition so that the player can observe the areas A1, A2, A3, and A4. For example, a given picture may be drawn corresponding to the areas A1, A2, A3, and A4, or the areas A1, A2, A3, and A4 may be colored, or may be displayed using illuminations or the like. This makes it possible to notify the player of the winning condition. Note that the winning condition may not be displayed (presented) to the player when the player can necessarily determine the winning condition (e.g., "bingo").

It is determined that the player has won the game when the game halls have been placed at three determination points HP11, HP21, and HP31 included in the area A1. The player aims to win the game by releasing the play balls toward the determination points included in the areas A1 A2, A3, and A4.

The determination points included in the areas A1, A2, A3, and A4 are referred to as "winning determination point". The determination points that are not included in the areas A1, A2, A3, and A4 are referred to as "non-winning determination point".

FIG. 6B illustrates an example of the winning condition set to the determination points included in the determination area illustrated in FIG. 6A. The winning condition may be stored in the storage section in advance, or may be incorporated in a program as the determination condition.

The winning condition and a bonus given to the player when the player has won the game may be stored corresponding to a winning condition ID. The winning condition may be defined by a combination of the determination points that must be set to the hit state in order to win the game.

The first winning condition is the winning condition corresponding to the area A1. The first winning condition specifies that the player wins the game when the determination points HP11, HP21, and HP31 have been set to the hit state, and 30 points are given to the player as a bonus. The second winning condition is the winning condition corresponding to the area A2. The second winning condition specifies that the player wins the game when the determination points HP32, HP42, HP52, and HP62 have been set to the hit state, and 40 points are given to the player as a bonus. The third winning condition is the winning condition corresponding to the area A3. The third winning condition specifies that the player wins the game when the determination points HP33 and HP34 have been set to the hit state, and 20 points are given to the player as a bonus. The fourth winning condition is the winning condition corresponding to the area A4. The fourth winning condition specifies that the player wins the game when the determination points HP54 and HP64 have been set to the hit state, and 20 points are given to the player as a bonus.

The player wins the game when the determination points on the board surface that have been set to the hit state fall under a winning condition among the first to fourth winning conditions. The player achieves multiple winning when the determination points set to the hit state fall under a plurality of winning conditions. For example, when the game halls have been placed at the hit points HP11, HP21, HP31, HP54, and HP64, the first winning condition (combination) and the fourth winning condition (combination) are satisfied.

The hit state set to the determination point may be maintained until the hit state is reset. For example, when the game ball has hit the hit point HP11, the hit state is maintained. When the game balls have then hit the hit points HP21 and HP31, it is determined that the first winning condition has been satisfied, and the player has won the game. When the game balls have hit the hit points HP11, HP21, and HP31 at the same time, it is determined that the first winning condition has been satisfied, and the player has won the game. In one embodiment of the invention, since a plurality of play balls are released to the game space at the same time, a plurality of play balls may hit the hit points at the same time, and the player can win the game even when the number of release operations is smaller than the number of hit points specified by the winning condition.

For example, when the game ball has hit the hit points HP11, HP21, and HP51, the hit state is maintained. When the game balls have then hit the hit points HP31 and HP64, it is determined that the first winning condition and the second winning condition have been satisfied, and the player has achieved double winning. When the game balls have hit the hit points HP11, HP21, HP31, HP54, and HP64 at the same time, it is determined that the first winning condition and the second winning condition have been satisfied at the same time, and the player has won the game.

According to one embodiment of the invention, since a plurality of play balls are released at the same time, the player can satisfy a plurality of winning conditions by performing a single release operation.

According to a known bingo game that is designed so that whether or not one game medium has hit the hit point is determined, double reach, triple reach, and the like are limited to a position at which one point has satisfied a plurality of reach conditions. A known bingo game cannot implement a game in which the player can achieve multiple winning when a plurality of winning conditions do not involve overlapping determination points (see FIGS. 6A and 6B).

However, when a plurality of play halls are released at the same time, it is possible to cause the game media to hit a plurality of determination points that are situated away from each other (e.g., HP31 and HP64) at the same time.

When the player has won the game, the points specified by the winning condition are given to the player.

2-2. Winning Determination Point and Non-Winning Determination Point

In one embodiment of the invention, the winning determination point that must be hit by the game medium (at which the game medium must be placed or pass through a checker) in order to satisfy the winning condition, and the non-winning determination point are set to the determination area.

For example, when a plurality of hit points HP11 to HP64 are set to the board surface (i.e., determination area) (see FIG. 6A), and the first to fourth winning conditions are specified (see FIG. 6B), it is necessary to cause the game media to hit the hit points HP11, HP21, and HP31 in order to satisfy the first winning condition. Therefore, the hit points HP11, HP21, and HP31 fall under the winning determination point. Since it is necessary to cause the game media to hit the hit points HP32, HP42, HP52, and HP62 in order to satisfy the second winning condition, the hit points HP32, HP42, HP52, and HP62 fall under the winning determination point. Since it is necessary to cause the game media to hit the hit points HP33 and HP34 in order to satisfy the third winning condition, the hit points HP33 and HP34 fall under the winning determination point. Since it is necessary to cause the game media to hit the hit points HP54 and HP64 in order to satisfy the fourth winning condition, the hit points HP54 and HP64 fall under the winning determination point.

The remaining hit points (determination points) HP41, HP51, HP61 . . . fall under the non-winning determination point.

A bonus (e.g., points) may be given to the player independently of the winning condition when the non-winning determination point has been set to the hit state. Such a modification is included within the scope of the invention. For example, a bonus may be given to the player independently of the winning condition when a given determination point has been set to the hit state.

2-3. Reset Control

In one embodiment of the invention, the first reset process that resets the hit state of a plurality of determination points that have satisfied the winning condition is performed after the win determination process has been performed.

The second reset process that removes the game medium placed at the non-winning determination point from the non-winning determination point is performed after the win determination process has been performed.

Figure 7:
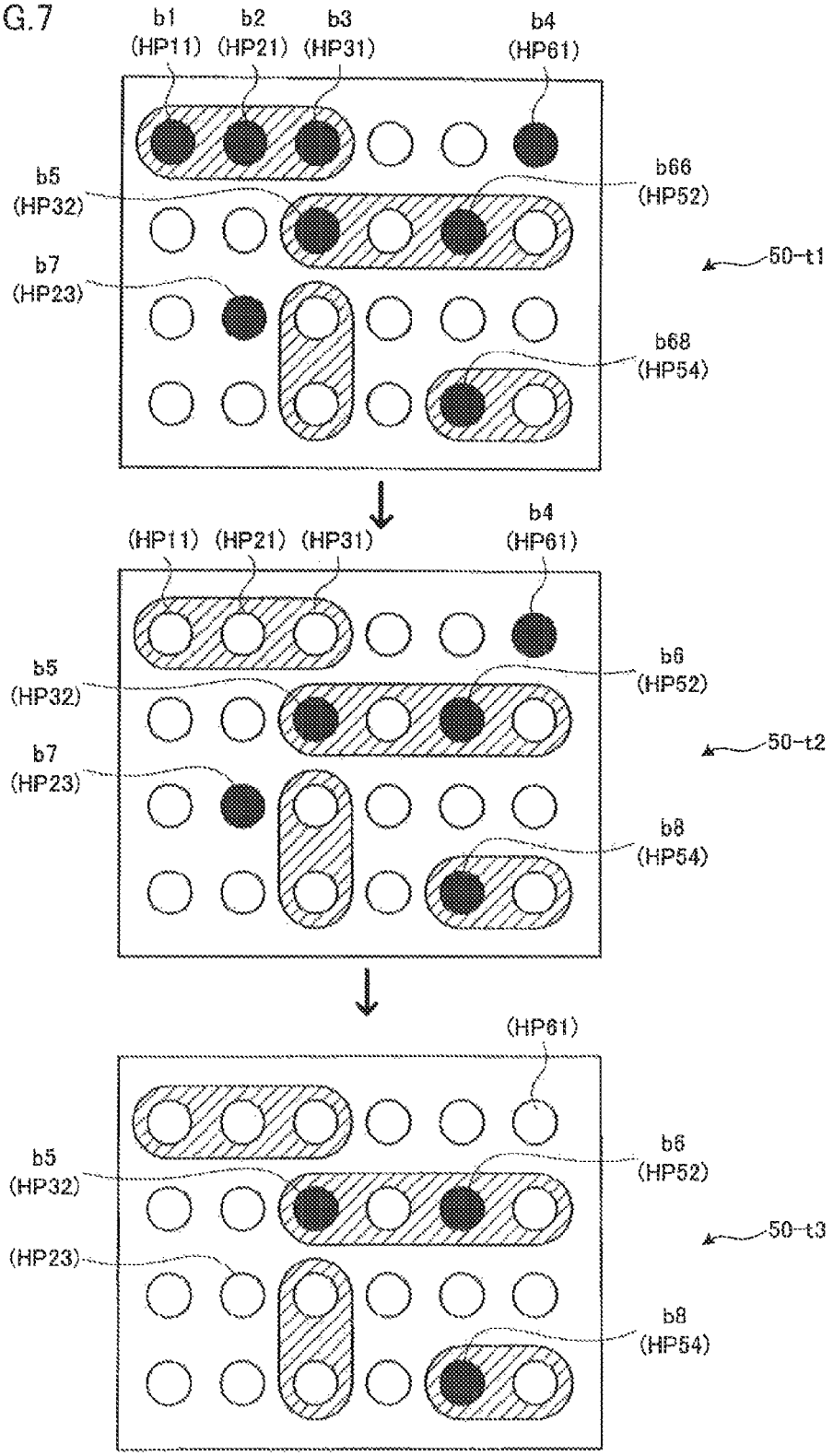
FIG. 7 is a diagram illustrating a first reset process and a second reset process.

FIG. 7 is a diagram illustrating the first reset process and the second reset process.

50-t1 illustrates the state of the board surface during the win determination process. The determination points HP11, HP21, HP31, HP61, HP32, HP52, HP23, and HP54 have been set to the hit state (e.g., a state in which the game ball is placed). Since the hit points HP11, HP21, and HP31 have been set to the hit state, the first winning condition has been satisfied.

Therefore, the first reset process that resets the hit state of the hit points HP11, HP21 and HP31 that have satisfied the first winning condition is performed after the win determination process has been performed. For example, the game balls placed at the determination points that have satisfied the winning condition are removed from the determination points.

50-t2 illustrates the state of the board surface after the first reset process has been performed. The hit state of the determination points HP11, HP21, and HP31 has been canceled.

Since the non-winning points HP61 and HP23 have been set to the hit state (i.e., a state in which the game ball is placed), the second reset process that removes the game medium placed at the non-winning determination point from the non-winning determination point is performed.

50-t3 illustrates the state of the board surface after the second reset process has been performed. The hit state of the determination points HP61 and HP23 has been canceled.

Figure 8:
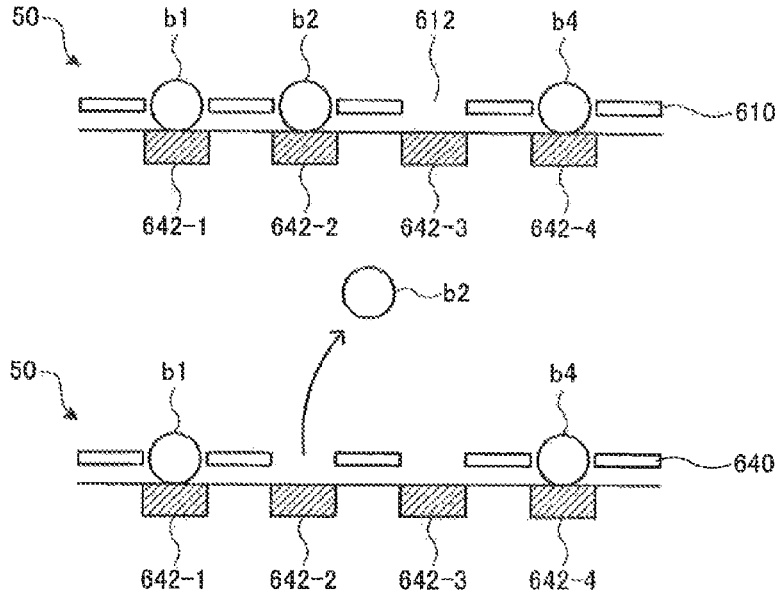
FIG. 8 illustrates a configuration example for implementing a first reset process.
Figure 14A:
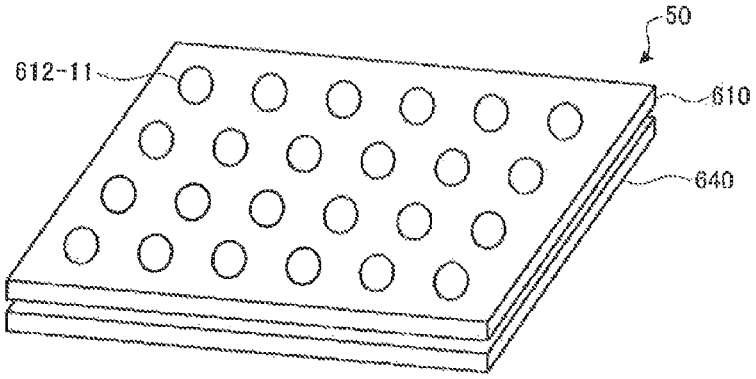
FIGS. 14A and 14B illustrate a configuration example for implementing a first reset process.
Figure 14B:
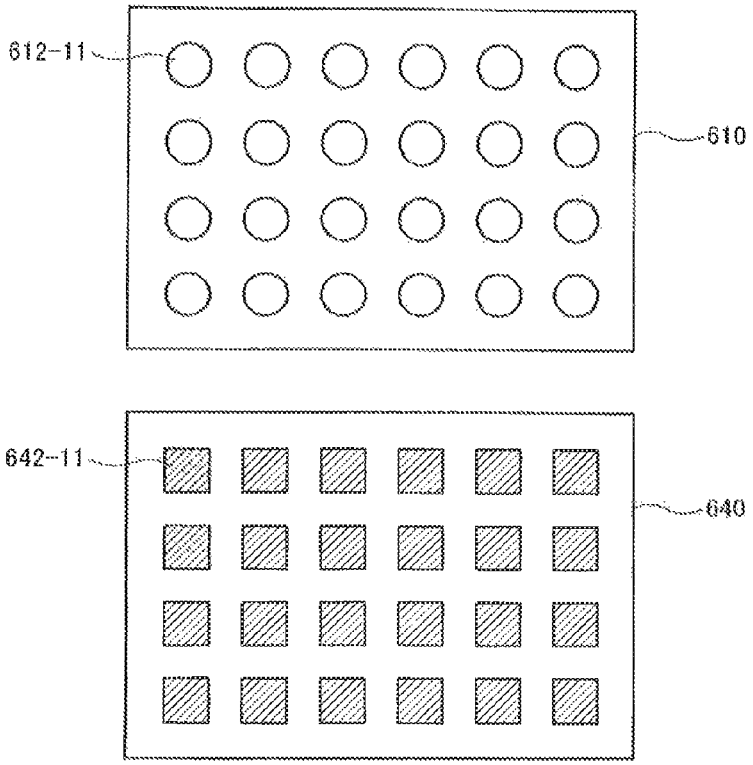

FIGS. 8, 14A, and 14B illustrate a configuration example for implementing the first reset process.

As illustrated in FIGS. 8, 14A, and 14B, the board surface 50 may be formed by a two-layer structure that includes a plate-shaped first member (board surface member) 610 in which a plurality of holes 612 corresponding to a plurality of determination points are formed, and a plate-shaped fourth member (placement member) 640 on which the game ball that has entered the hole 612 is placed, for example. The board surface member 610 may be disposed on the upper side, and the placement member 640 may be disposed on the lower side. A release mechanism 642 (e.g., solenoid) for releasing the game ball placed in the hole from the hole is provided to the fourth member 640 at a position corresponding to the hole 612 formed in the first member 610. The release mechanism 642 (e.g., solenoid) is driven when a removal signal has been received, and removes the play ball placed in the hole from the hole. FIG. 8 illustrates a state in which a solenoid 642-2 is driven based on the removal signal, and removes a game ball b2 placed in the hole from the hole.

The first reset processing section may perform a process that instructs generation of the removal signal for driving the release mechanism solenoid) corresponding to the determination point that satisfies the winning condition after the win determination process has been performed. For example, when the first winning condition has been satisfied, the release mechanisms (e.g., solenoid) corresponding to the determination points HP11, HP21, and HP31 are driven to remove the game balls placed at the determination points HP11, HP21, and HP31.

Figure 9:
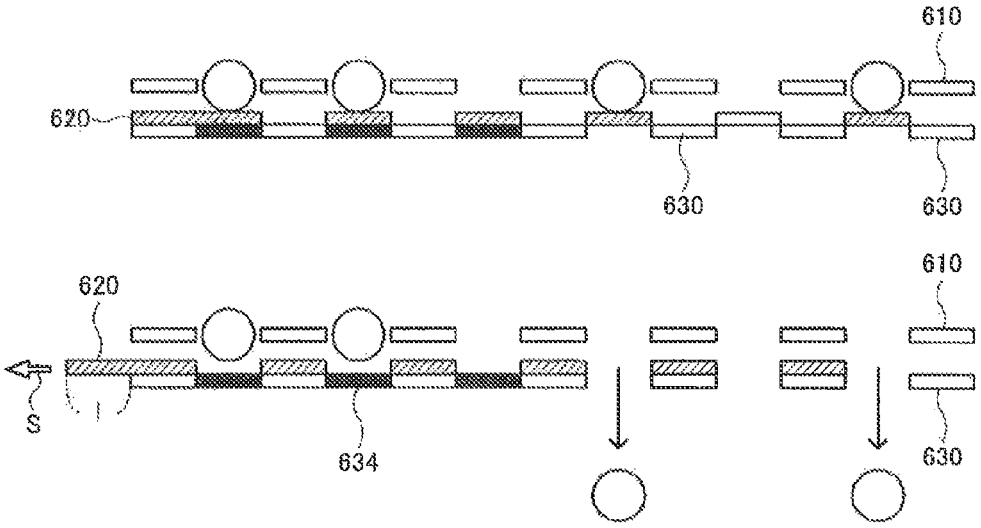
FIG. 9 illustrates a configuration example for implementing a second reset process.
Figure 10A:
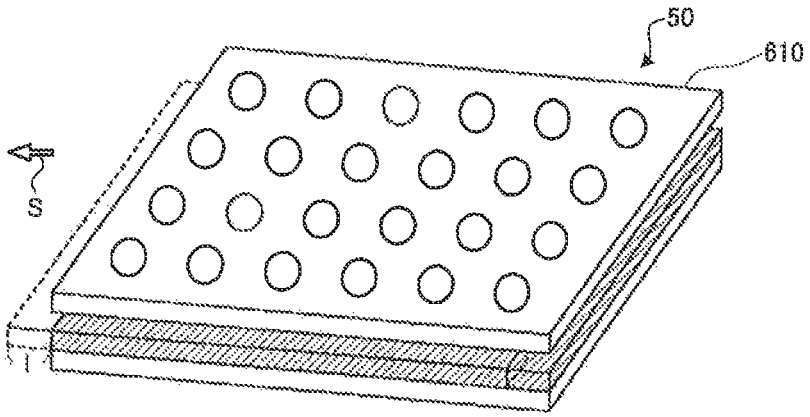
FIGS. 10A and 10B illustrate a configuration example for implementing a second reset process.
Figure 10B:
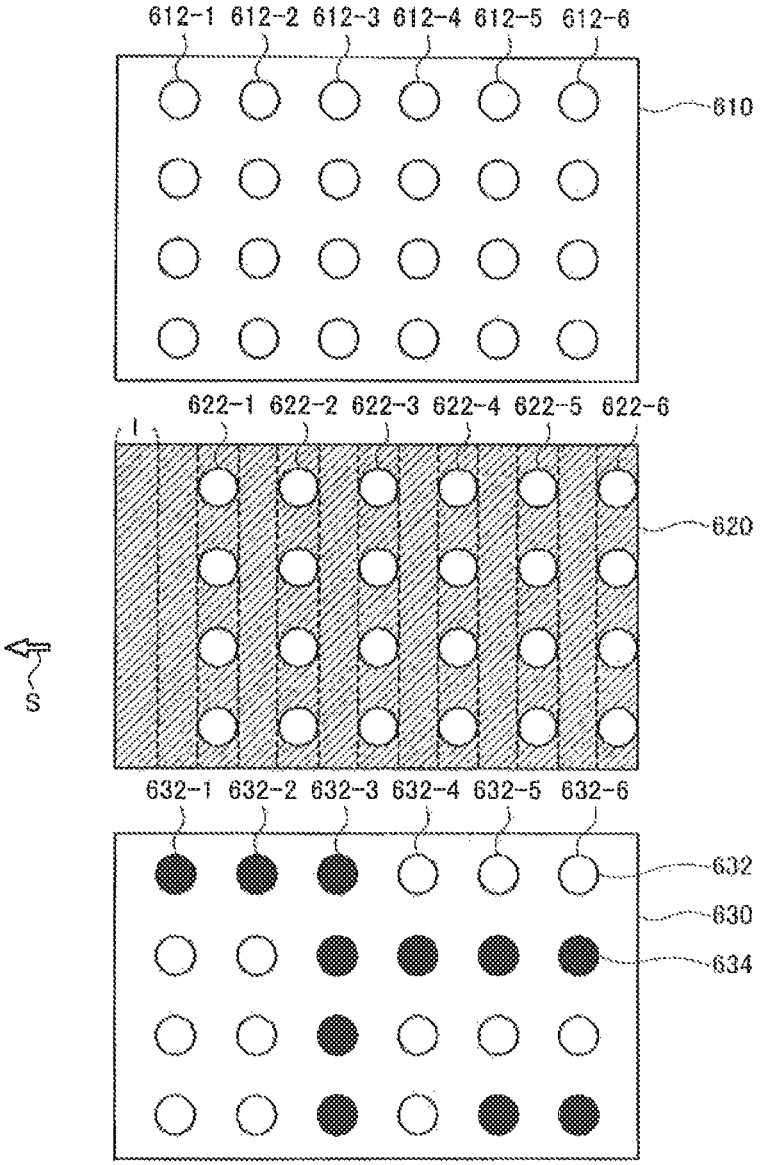

FIGS. 9, 10A, and 10B illustrate a configuration example for implementing the second reset process.

As illustrated in FIGS. 9, 10A, and 10B, the board surface 50 may be formed by a three-layer structure that includes a plate-shaped first member 610 in which a plurality of holes 612 corresponding to a plurality of determination points are formed, a plate-shaped second member 620 in which a plurality of holes 622 corresponding to a plurality of determination points are formed, and a plate-shaped third member 630 in which a plurality of holes 632 corresponding to a plurality of determination points are formed, wherein the holes corresponding to the non-winning determination points (see the white circles formed in the third member 630 illustrated in FIG. 10B) are not closed, and allow the game ball to pass through, and the holes corresponding to the winning determination points (see the black circles formed in the third member 630 illustrated in FIG. 10B) are closed, and do not allow the game ball to pass through, for example. The first member 610 is disposed on the upper side, the third member 630 is disposed on the lower side, and the second member 620 is slidably disposed between the first member 610 and the third member 630. As illustrated in FIGS. 9, 10A, and 10B, the board surface 50 may be formed so that the holes formed in the first member 610 and the holes formed in the second member 620 coincide with each other by sliding the second member 620 by the amount 1 in the direction S. According to this configuration, the game ball placed at the non-winning point falls downward (falls onto the lower part of the housing) (i.e., can be removed from the determination point) by sliding the second member 620.

2-4. Ball Retention Section

Figure 11:
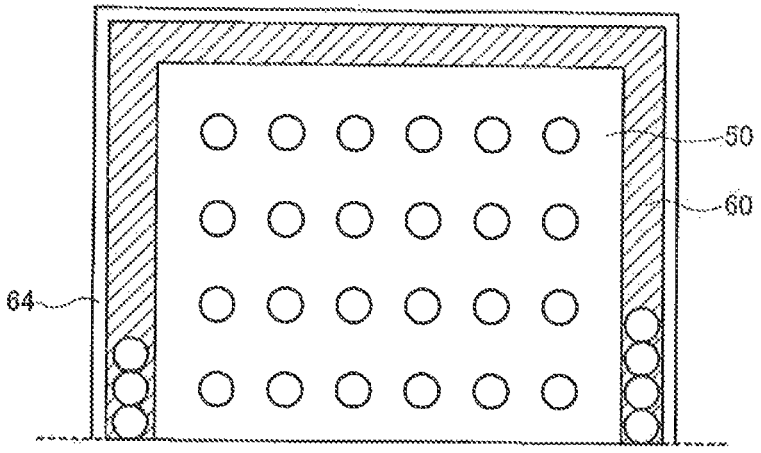
FIG. 11 illustrates a ball retention section.
Figure 18:
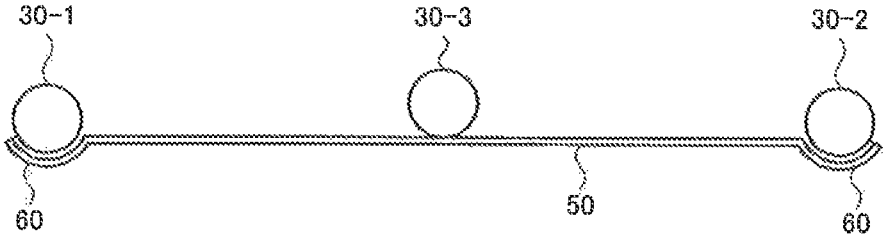
FIG. 18 illustrates a ball retention section.

FIGS. 11 and 18 illustrate the ball retention section.

FIG. 11 is a top view illustrating the board surface and the ball retention section, and FIG. 18 is a vertical cross-sectional view illustrating the board surface and the ball retention section. As illustrated in FIG. 11, the ball retention section 60 that can retain the game ball is formed along three sides (i.e., the left side, the right side, and the interior side when viewed from the player) of the outer frame of the board surface 50 (i.e., determination area).

As illustrated in FIG. 18, the ball retention section 60 is formed in the form of a groove-like member (i.e., a gutter-like member that may be formed as an arc-like groove so that the play ball easily rolls) provided along the outer edge of the board surface. The play ball is retained by the ball retention section at a position lower to some extent than the board surface. Since the upper part of the game ball placed in the ball retention section is positioned higher than the board surface (see FIG. 18), the game ball placed in the ball retention section serves as a wall, and the play ball that has been released and moves on the board surface is bounced from the wall, and does not easily fall from the board surface. Therefore, the released play ball is easily placed at the determination point.

Figure 12A:
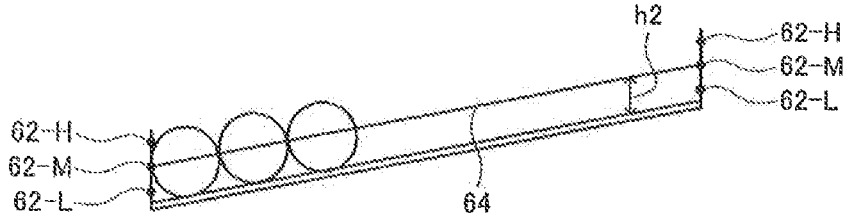
FIGS. 12A to 12C illustrate adjustment of the degree by which a game ball is retained by a ball retention section.
Figure 12B:
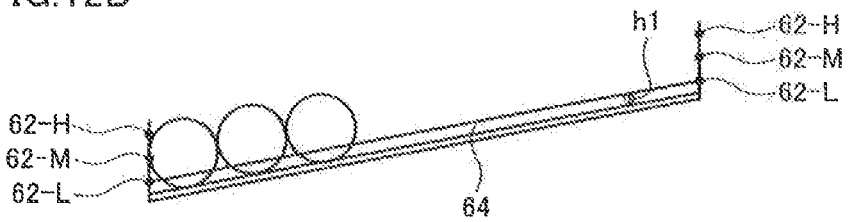
Figure 12C:
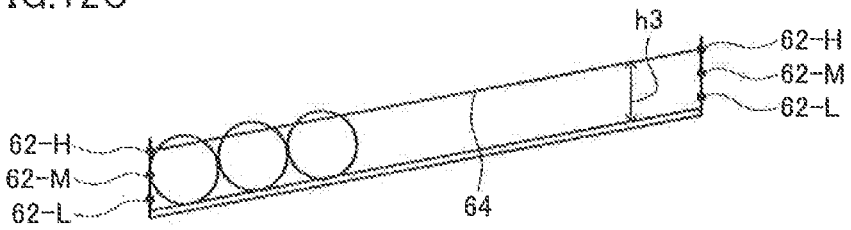

FIGS. 12A to 12C illustrate adjustment of the degree by which the game ball is retained by the ball retention section.

Reference sign 64 in FIG. 11 indicates a fall prevention bar provided to the ball retention section. The fail prevention bar is provided on the side of the ball retention section opposite to the board surface.

The height of the fail prevention bar illustrated in FIG. 12A is h2, the height of the fall prevention bar illustrated in FIG. 12B is h1 the height of the fall prevention bar illustrated in FIG. 12C is h3, and h1<h2<h3 is satisfied. The fall prevention effect increases (i.e., the game ball is more easily retained by the ball retention section) as the height of the fall prevention bar increases. Therefore, the wall effect of the ball retention section increases, and the game ball is easily placed at the determination point.

2-5. Attraction Process

In one embodiment of the invention, the game machine 1 may perform an automatic play control process that determines whether or not the occurrence or non-occurrence of the predetermined event at the determination point satisfies a predetermined condition during an attraction process, and releases the game medium to the determination area independently of an operation input performed by the player when it has been determined that the predetermined condition is satisfied.

According to this configuration, the hit state of the determination point in the determination area can be adjusted while achieving an attraction effect during the attraction process or the like. It is possible to highly motivate the player to start the game by creating a situation in which the player can nearly win the game.

2-6. Difficulty Level Adjustment Process

In one embodiment of the invention, the game machine 1 may perform a difficulty level adjustment process that adjusts the difficulty level based on historical information about the results of the win determination process.

The historical information about results of the win determination process may be statistical information about the results of the win determination process for a predetermined past period (e.g., x hours).

The historical information may be compared with a specific reference to adjust the difficulty level.

For example, the difficulty level may be adjusted by adjusting the release position of the game medium release means. When the release position is high, the game medium is not easily placed at the determination point as compared with the case where the release position is low. Therefore, the height of the release position may be increased when it is desired to increase the difficulty level.

The difficulty level may also be adjusted by adjusting the holding force when the game medium release means catches the game medium placed in the game medium storage section using a holding section. The game medium can be easily held when the holding force is high, and the number of game media held by the holding section increases. Therefore, the holding force may be decreased when it is desired to increase the difficulty level.

The difficulty level may also be adjusted by adjusting the slope of the hoard surface (determination area). The game medium is not easily placed at the determination point as the slope of the board surface increases. Therefore, the slope of the board surface may be increased when it is desired to increase the difficulty level.

The difficulty level may also be adjusted by adjusting the height or the angle of the fall prevention member that is provided along the outer edge of the retention area, and prevents a situation in which the game medium falls (moves) from the retention area. The game medium rarely falls from the retention area when the height of the fall prevention member is high. Specifically, the number of game media retained by the retention area increases the wall effect increases), and the game medium is easily placed at the determination point. Therefore, the height of the fall prevention member may be decreased when it is desired to increase the difficulty level.

2-7. Flow of Process

Figure 15:
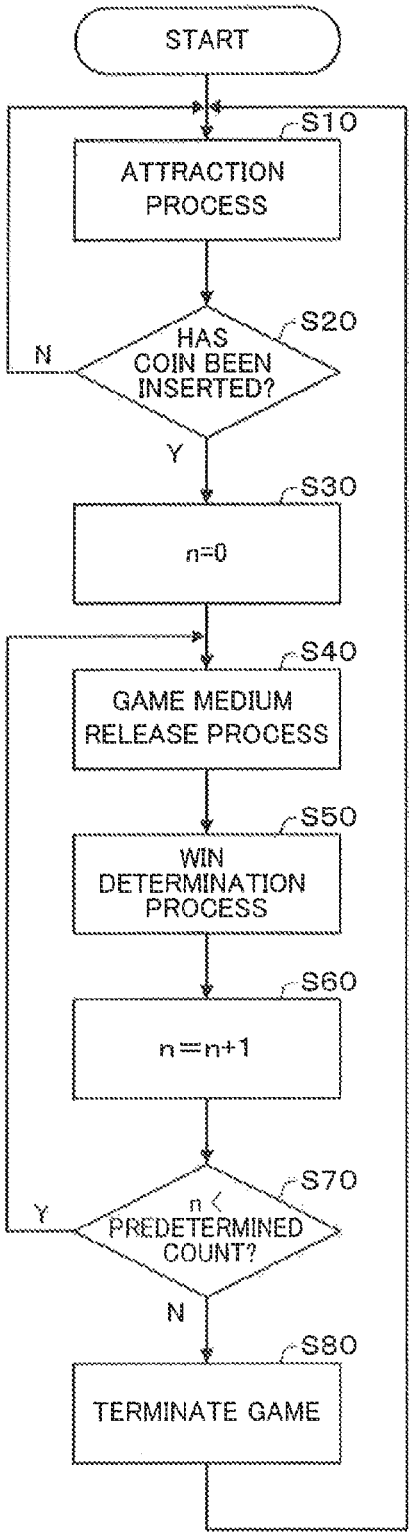
FIG. 15 is a flowchart illustrating the flow of a process performed by a game machine according to one embodiment of the invention.

FIG. 15 is a flowchart illustrating the flow of the entire process performed by the game machine.

The game machine performs the attraction process when a coin has not been inserted (step S10). For example, the game machine may perform the automatic play control process that determines whether or not the occurrence or non-occurrence of the predetermined event at the determination point satisfies a predetermined condition, and releases the game medium to the determination area independently of an operation input performed by the player when it has been determined that the predetermined condition is satisfied.

When the game machine has detected that a coin has been inserted (Y in step S20), the following process is performed. A variable n is initialized (step S30). The variable n is a variable for counting the play count (i.e., the number of release operations). The play count is determined based on the number of coins inserted. For example, when n coins have been inserted, the play count may be determined to be N (N=predetermined play count). When the predetermined play count is N, the player can perform the game medium release operation N times.

The game medium release process is performed (step S40), and the win determination process is performed (step S50). The variable n is updated (step S60), and whether or not the variable n has reached the predetermined count is determined (step S70). When the variable n has not reached the predetermined count (Y in step S70), the steps S40 to S70 are performed. When the variable n has reached the predetermined count (N in step S70), the game is terminated (step S80), and the step S10 is performed.

Figure 16:
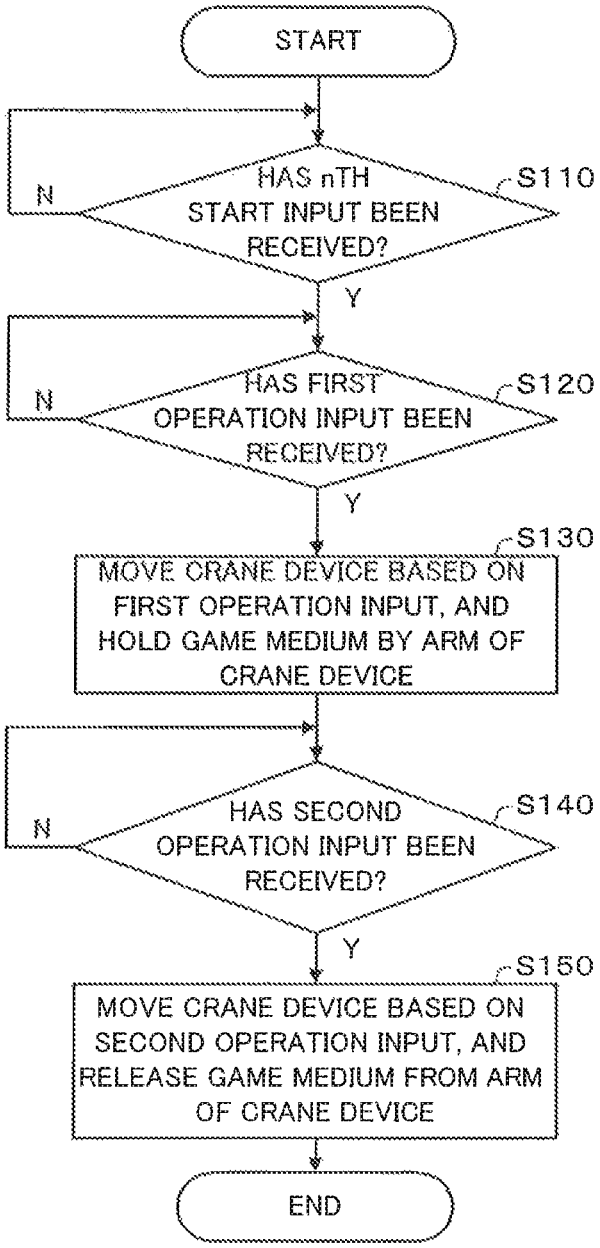
FIG. 16 is a flowchart illustrating the flow of a process performed by a game machine according to one embodiment of the invention.

FIG. 16 is a flowchart illustrating the flow of the game medium release process according to one embodiment of the invention.

When nth release operation start input has been received (Y in step S110), the following process is performed. When the first operation input has been received (Y in step S120), the crane device is moved based on the first operation input, and the game medium is held by the arm of the crane device (step S130).

When the second operation input has been received (Y in step S140), the crane device is moved based on the second operation input, and the game medium is released from the arm of the crane device (step S150).

Figure 17:
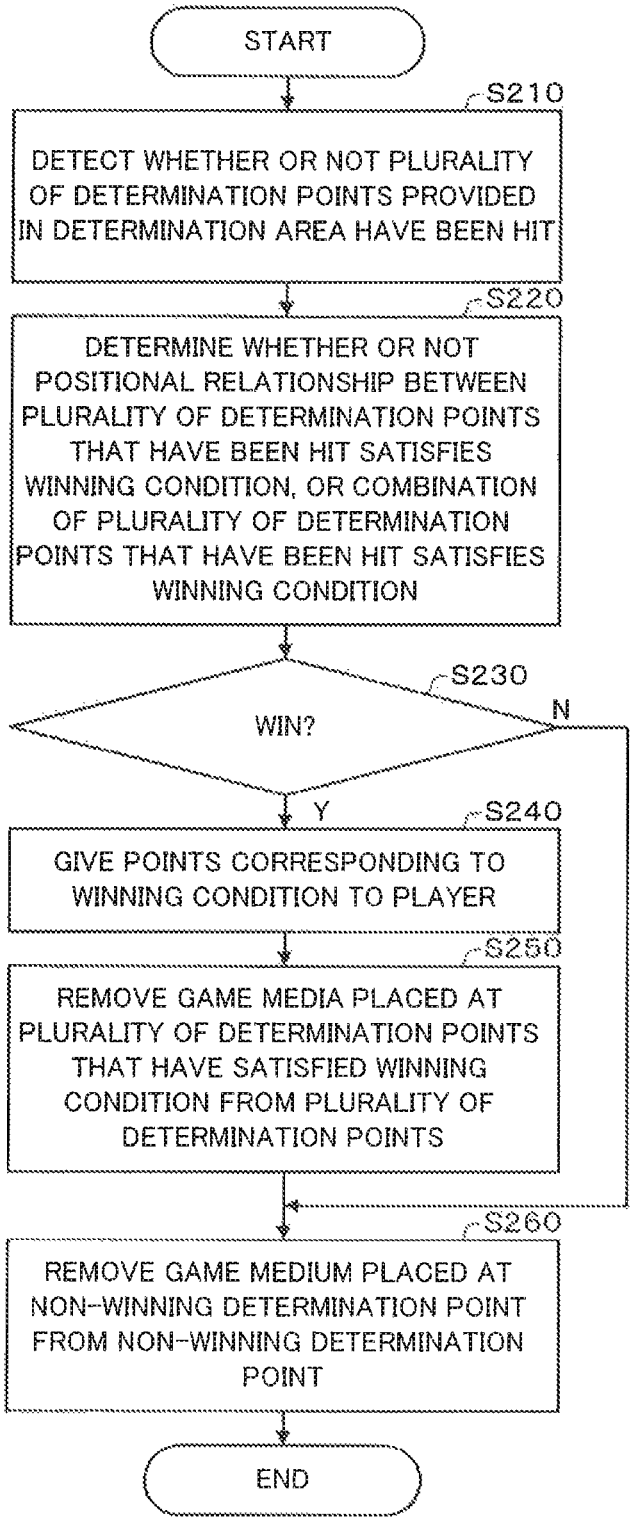
FIG. 17 is a flowchart illustrating the flow of a process performed by a game machine according to one embodiment of the invention.

FIG. 17 is a flowchart illustrating the flow of the win determination process according to one embodiment of the invention.

The game machine detects whether or not a plurality of determination points provided in the determination area have been hit (step S210). When the positional relationship between a plurality of determination points that have been hit satisfies the winning condition, or a combination of a plurality of determination points that have been hit satisfies the winning condition (Y in step S220), points corresponding to the winning condition is given to the player (step S240), and the game machine removes the game media placed at the plurality of determination points that have satisfied the winning condition from the plurality of determination points (step S250). The game machine removes the game medium placed at the non-winning determination point from the non-winning determination point (step S260).

The methods described in connection with the above embodiments are merely an example. The scope of the invention also includes the case of employing a method that achieves effects similar to those of the methods described in connection with the above embodiments. The invention is not limited to the above embodiments. Various modifications and variations may be made of the above embodiments. Various methods described in connection with the above embodiments and modifications thereof may be appropriately used in combination as a method that implements the invention.

Although only some embodiments of the invention have been described in detail above, those skilled in the art would readily appreciate that many modifications are possible in the embodiments without materially departing from the novel teachings and advantages of the invention. Accordingly, all such modifications are intended to be included within the scope of the invention.

What is claimed is:

1. A game machine that includes a plurality of game media, a housing that forms a game space that includes a determination area, and an operation section that receives an operation input performed by a player, the game machine comprising:

a controller; and a crane device and a linear motion stage adapted to be arranged in the housing;

the controller is configured to control the crane device, which holds the plurality of game media, and the linear motion stage to release, in response to a single operation input from the operation section, the plurality of game media to the determination area included in the game space at the same time based on the single operation input from the operation section;

control a sensor to detect the occurrence or non-occurrence of a predetermined event at a plurality of determination points provided in the determination area, the predetermined event occurring due to the plurality of game media which have been released; and perform a win determination process based on the occurrence or non-occurrence of the predetermined event at the plurality of determination points provided in the determination area, determine that the player has won a game when a plurality of determination points among the plurality of determination points at which the predetermined event has occurred satisfy a winning condition.

2. The game machine as defined in claim 1, wherein the plurality of determination points are configured so that the plurality of game media which have been released can be placed, and wherein the controller is further configured to detect that the predetermined event has occurred at a determination point among the plurality of determination points when at least one game medium among the plurality of game media which have been released is placed at the determination point.

3. The game machine as defined in claim 1, wherein the crane device and the linear motion stage determine a release position within the determination area based on an other operation input from the operation section, and release the plurality of game media at the determined release position.

4. The game machine as defined in claim 2, wherein the crane device and the linear motion stage determine a release position within the determination area based on an other operation input from the operation section, and release the plurality of game media at the determined release position.

5. The game machine as defined in claim 1, further comprising a game medium storage section provided in the game space, game media among the plurality of game media being placed in the game medium storage section, wherein the crane device and the linear motion stage include catch means that catches the game media placed in the game medium storage section based on an other operation input from the operation section, and the controller is further configured to control the catch means to release the game media caught by the catch means to the determination area.

6. The game machine as defined in claim 2, further comprising a game medium storage section provided in the game space, game media among the plurality of game media being placed in the game medium storage section, wherein the crane device and the linear motion stage includecatch means that catches the game media placed in the game medium storage section based on an other operation input from the operation section, and the controller is further configured to control the catch means to release the game media caught by the catch means to the determination area.

7. The game machine as defined in claim 3, further comprising a game medium storage section provided in the game space, game media among the plurality of game media being placed in the game medium storage section, wherein the crane device and the linear motion stage include catch means that catches the game media placed in the game medium storage section based on the other operation input from the operation section, and the controller is further configured to control the catch means to release the game media caught by the catch means to the determination area.

8. The game machine as defined in claim 4, further comprising a game medium storage section provided in the game space, game media among the plurality of game media being placed in the game medium storage section, wherein the crane device and the linear motion stage include catch means that catches the game media placed in the game medium storage section based on the other operation input from the operation section, and the controller is further configured to control the catch means to release the game media caught by the catch means to the determination area.

9. The game machine as defined in claim 2, wherein the controller is further configured to:

control a first reset control section to reset the predetermined event that has occurred at the plurality of determination points that have satisfied the winning condition after the controller has performed the win determination process.

10. The game machine as defined in claim 4, wherein the controller is further configured to:

control a first reset control section to reset the predetermined event that has occurred at the plurality of determination points that have satisfied the winning condition after the controller has performed the win determination process.

11. The game machine as defined in claim 6, wherein the controller is further configured to:

control a first reset control section to reset the predetermined even that has occurred at the plurality of determination points that have satisfied the winning condition after the controller has performed the win determination process.

12. The game machine as defined in claim 8, wherein the controller is further configured to:

control a first reset control section to reset the predetermined event that has occurred at the plurality of determination points that have satisfied the winning condition after the controller has performed the win determination process.

13. The game machine as defined in claim 9, wherein a winning determination point at which the predetermined event must occur in order to satisfy the winning condition, and a non-winning determination point are set to the determination area, wherein the controller is further configured to:

control a second reset control section to remove a game medium among the plurality of game media placed at the non-winning determination point from the non-winning determination point after the controller has performed the win determination process.

14. The game machine as defined in claim 10, wherein a winning determination point at which the predetermined event must occur in order to satisfy the winning condition, and a non-winning determination point are set to the determination area, wherein the controller is further configured to:

control a second reset control section to remove a game medium among the plurality of game media placed at the non-winning determination point from the non-winning determination point after the controller has performed the win determination process.

15. The game machine as defined in claim 11, wherein a winning determination point at which the predetermined event must occur in order to satisfy the winning condition, and a non-winning determination point are set to the determination area, wherein the controller is further configured to:

control a second reset control section to remove a game medium among the plurality of game media placed at the non-winning determination point from the non-winning determination point after the controller has performed the win determination process.

16. The game machine as defined in claim 12, wherein a winning determination point at which the predetermined event must occur in order to satisfy the winning condition, and a non-winning determination point are set to the determination area, wherein the controller is further configured to:

control a second reset control section to remove a game medium among the plurality of game media placed at the non-winning determination point from the non-winning determination point after the controller has performed the win determination process.

17. The game machine as defined in claim 2, wherein the controller is further configured to:

determine whether or not the occurrence or non-occurrence of the predetermined event at a determination point among the plurality of determination points satisfies a predetermined condition when the player does not play the game, and control the crane device to release the plurality of game media to the determination area independently of the single operation input performed by the player when it has been determined that the predetermined condition is satisfied.

18. The game machine as defined in claim 1, further comprising a retention area in which the plurality of game media which have been released can be retained provided along part of an outer edge of the determination area included in the game space.

19. The game machine as defined in claim 1, wherein the controller is further configured to:

adjust a difficulty level based on historical information about results of the win determination process.

* * * * *